US009879943B2

(12) United States Patent
Ray

(10) Patent No.: US 9,879,943 B2
(45) Date of Patent: Jan. 30, 2018

(54) FIREARM SUPPORT SYSTEM

(71) Applicant: James Mitchell Ray, Huntsville, TX (US)

(72) Inventor: James Mitchell Ray, Huntsville, TX (US)

( * ) Notice: Subject to any disclaimer, the term of this patent is extended or adjusted under 35 U.S.C. 154(b) by 0 days.

(21) Appl. No.: 15/046,428

(22) Filed: Feb. 17, 2016

(65) Prior Publication Data

US 2016/0238341 A1 Aug. 18, 2016

Related U.S. Application Data

(60) Provisional application No. 62/117,438, filed on Feb. 17, 2015.

(51) Int. Cl.
*F41C 33/00* (2006.01)

(52) U.S. Cl.
CPC ..... *F41C 33/003* (2013.01)

(58) Field of Classification Search
CPC ..... F41C 33/003
USPC ..... 224/149, 198, 200, 197, 667
See application file for complete search history.

(56) References Cited

U.S. PATENT DOCUMENTS 2,873,902 A * 2/1959 Decker ..... F41C 33/007 224/257
3,664,558 A * 5/1972 Tolliver ..... F41C 33/003 224/149
3,700,147 A * 10/1972 Vaughn ..... F41C 33/005 224/149
5,014,892 A * 5/1991 Copeland ..... A45F 5/02 224/242
5,056,696 A * 10/1991 Lahr ..... A45F 5/02 224/148.4
5,058,788 A * 10/1991 Newmark ..... A45F 5/00 224/198
5,182,877 A * 2/1993 Burchill ..... A01K 97/00 206/315.11
5,511,704 A * 4/1996 Linderer ..... A45F 5/02 224/240
6,233,788 B1 * 5/2001 Choy ..... A45F 5/02 224/197
6,761,294 B2 * 7/2004 Gann ..... F41C 23/02 224/150
8,943,730 B2 2/2015 Ascano
2013/0276343 A1 * 10/2013 Peters ..... F41C 33/006 42/90

OTHER PUBLICATIONS http://tacticaluniversalclip.com/.
http://badcompanytactical.com/.
http://badcompanytactical.com/t/r2s-rifle-accessories.
http://www.strikeindustries.com/shop/index.php/strike-advanced-retention-system.html.

* cited by examiner

*Primary Examiner* — Corey Skurdal
(74) *Attorney, Agent, or Firm* — Lightfoot & Alford PLLC

(57) ABSTRACT

A firearm support system, has a stock unit configured to be carried by a firearm, the first unit having a first complementary component and a belt unit configured to be carried by a belt, the second unit having a second complementary component configured for selective engagement with the first complementary component.

10 Claims, 39 Drawing Sheets

*Picatinny Rail System overview*

*Knuckle Clamp overview*

FIREARM SUPPORT SYSTEM

CROSS-REFERENCE TO RELATED APPLICATIONS

This patent application claims the benefit of the filing date of the U.S. Provisional Patent Application Ser. No. 62/117,438, filed on Feb. 17, 2015 and entitled "Support System," the entire content of which is hereby expressly incorporated by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Some firearms, weapons, tools, and/or other objects are carried in an uncomfortable manner. Some backpacks, backpack frames, tools and/or other objects carried in an uncomfortable manner.

DETAILED DESCRIPTION

Figure 1:
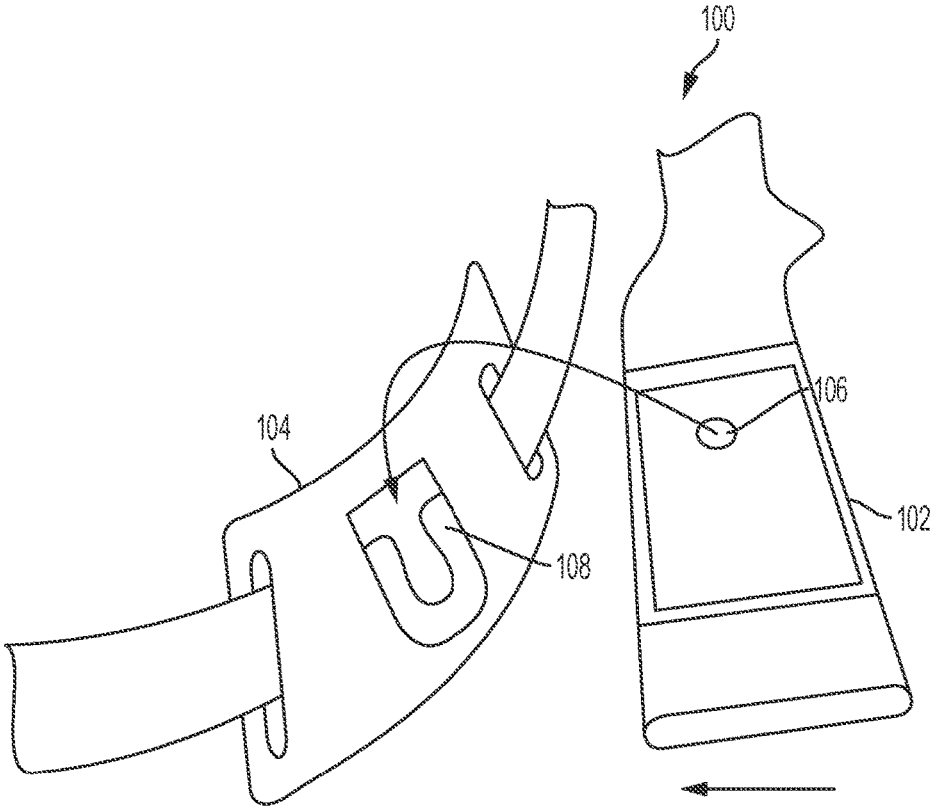
FIG. 1 is a schematic diagram of a firearm support system in an unassembled configuration according to an embodiment of the disclosure.
Figure 2:
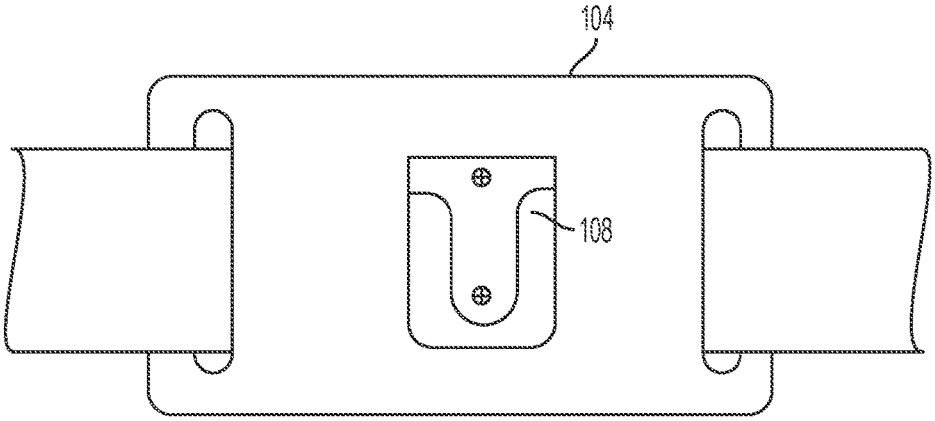
FIG. 2 is a front view of a belt unit of the firearm support system of FIG. 1.
Figure 3:
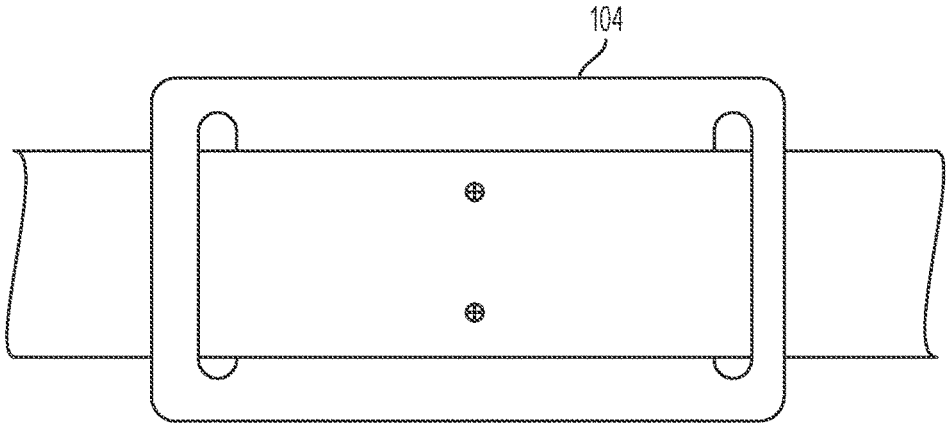
FIG. 3 is a rear view of the belt unit of FIG. 2.
Figure 4:
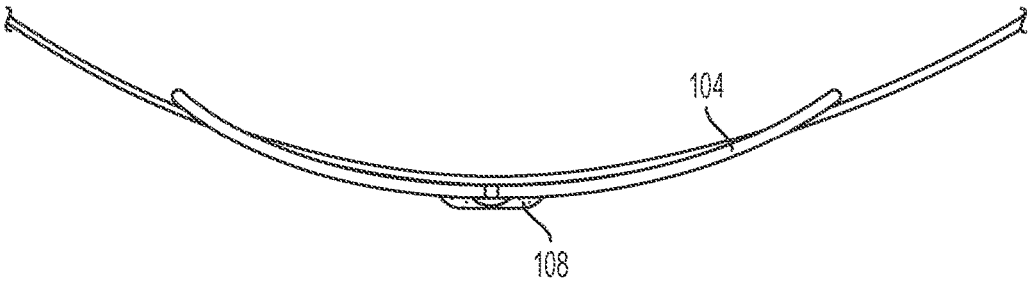
FIG. 4 is a top view of the belt unit of FIG. 2.
Figure 5:
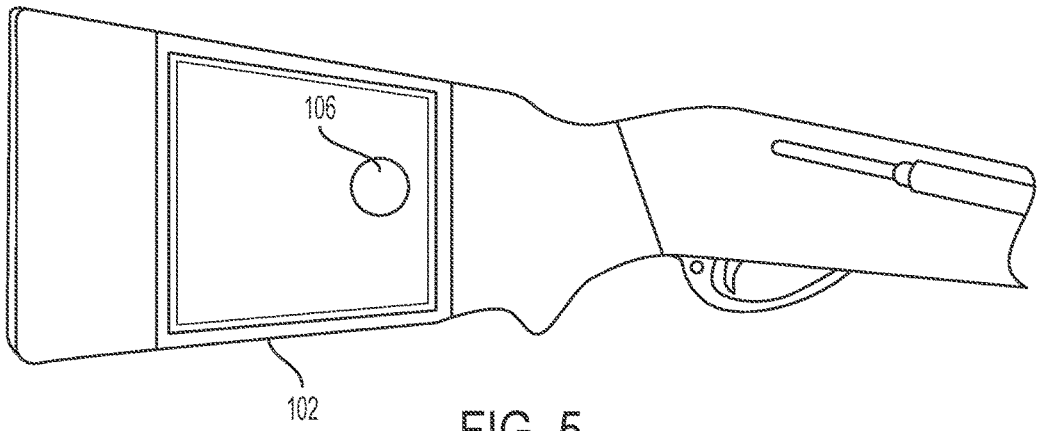
FIG. 5 is a side view of stock unit of the firearm support system of FIG. 1.
Figure 6:
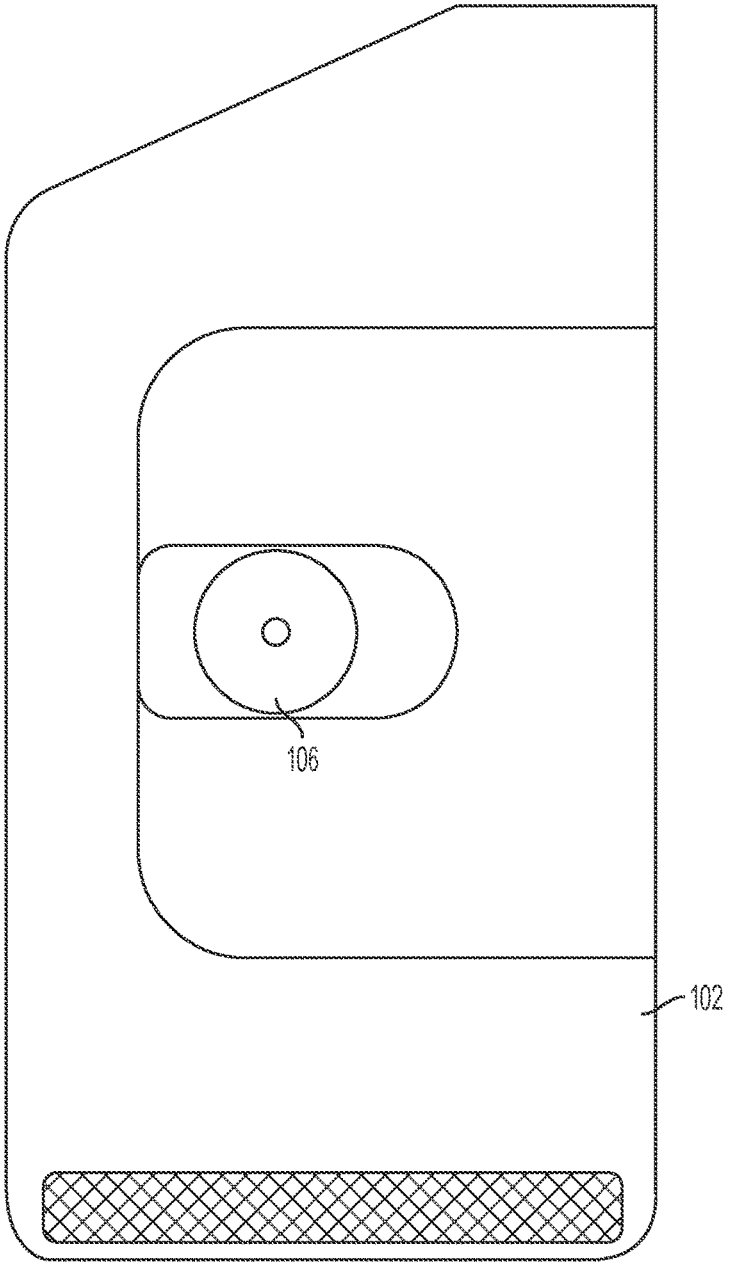
FIG. 6 is another side view of a stock unit of FIG. 5.
Figure 7:
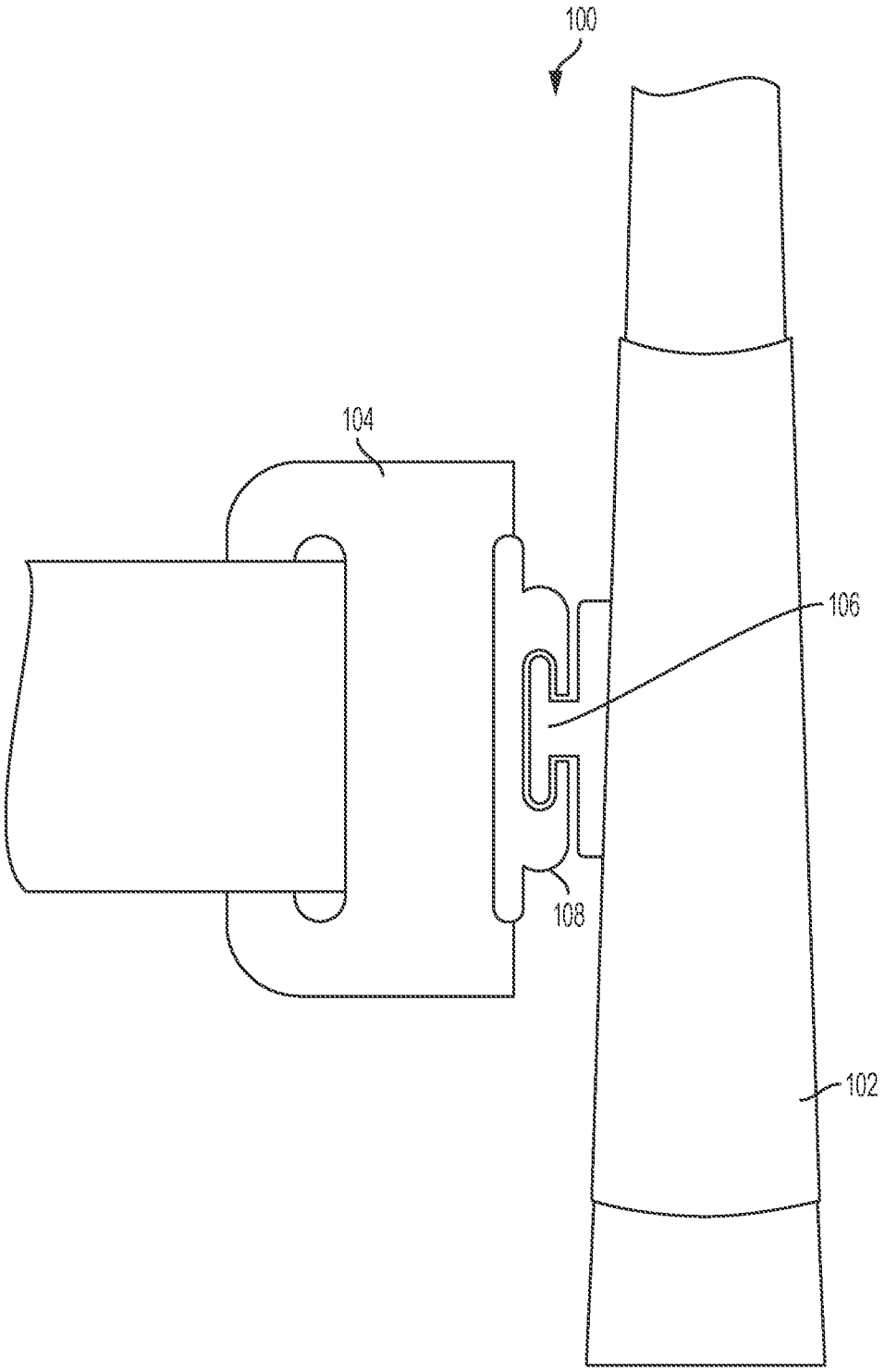
FIG. 7 is a schematic cutaway rear view of the firearm support system of FIG. 1 in an assembled configuration.

Referring now to FIGS. 1-7, a firearm support system (FSS) 100 is disclosed as comprising a stock unit 102 and a belt unit 104. The stock unit 102 comprises a first complementary component 106 and the belt unit 104 comprises a second complementary component 108 that is configured for selective engagement with the first complementary component 106. In this embodiment, the first complementary component 106 comprises a raised button, knuckle, and/or male component generally comprising a rounded head carried by a central shaft. In this embodiment, the second complementary component 108 comprises a U-shaped receiver channel configured to allow the central shaft to slide into the U-shaped receiver channel while also being configured to at least partially selectively capture the first complementary component 106.

In some embodiments, the stock unit 102 may be attached to a firearm (rifle, shotgun, long arm weapons, and/or the like). In some cases, the FSS 100 may be used in conjunction with use of a should strap and/or shoulder carrying sling. The belt unit 104 may comprise plastic and may be approximately 4" long and 1.5"-2" wide. A curvature in the belt unit 104 allows for a comfortable fit with an opening on each end of the belt unit 104 for the belt to be run through and attached to a user on the hip and/or waist area. The second complementary component 108 may be attached to the plastic unit and may comprise a long vertical area that allows the male part of first complementary component 106 to channel into the second complementary component 108 and be selectively held in place. In this embodiment, the belt unit 104 comprises no locking mechanism to keep the joinder between the first complementary component 106 and the second complementary component 108. However, in alternative embodiment, a locking mechanism such as a biased push button mechanism may be incorporated to keep the joinder between the first complementary component 106 and the second complementary component 108.

In some embodiments, one or more portions of the belt unit may be formed via a mold plastic injection that will have the receiver area pressed into the unit itself and may incorporate a tab system (rail and/or ramp system) that will automatically lock the male piece into place once it slides down passed the tab on the rail system. They safely can then be released by simply pushing the tab or rail so that the tab is retracted far enough for the male end to be pulled upwards past the tab. When a weapon is attached by a shoulder strap and a FSS, the weapon is securely connected in two areas providing additional safety, security, and/or comfort. Some embodiments of FSSs allow the user to transfer the weight of the weapon from the shoulder strap area to the hip area where the belt unit and stock unit join. When the weapon is unstrapped from the shoulder the weapon will still be attached to the belt unit and the barrel of the gun will rotate in a safer position pointing towards the ground, allowing user's hands to be free. The amount of weight transferred to the belt unit may be determined by the amount of tension that is applied to the weapon sling. The looser the sling, the more weight may be transferred to the belt unit.

In some embodiments, the stock unit may be primarily made of neoprene which stretches to make a custom fit on the stock. Velcro is attached to one end of the stock piece and the user wraps the unit around the stock and joins the two ends using the Velcro, making a custom tight fit. The male part (or knuckle) is attached to the neoprene and allows the weapon to be attached to user when the weapon is attached to the belt unit. The ability of the neoprene material, along with the Velcro allows the used to make a tight fit on the stock so when the weight of the weapon is applied, the stock unit will not bunch up towards the comb or neck of the stock.

Figure 8:
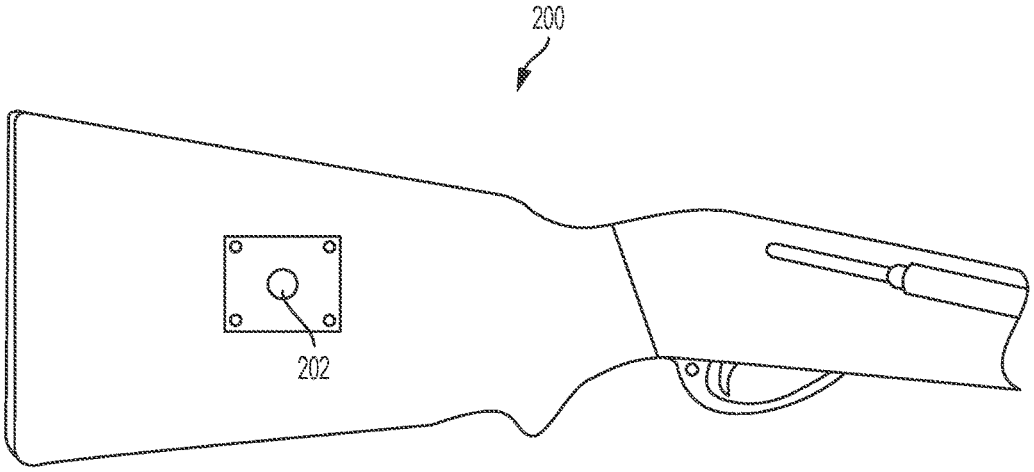
FIG. 8 is a schematic side view of an alternative embodiment of a stock unit in a retracted configuration.
Figure 9:
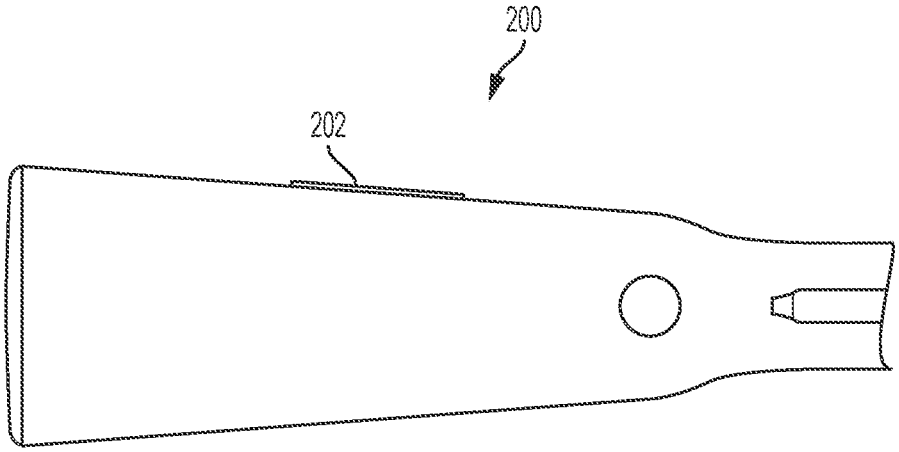
FIG. 9 is a schematic bottom view of the stock unit of FIG. 8 in the retracted configuration.
Figure 10:
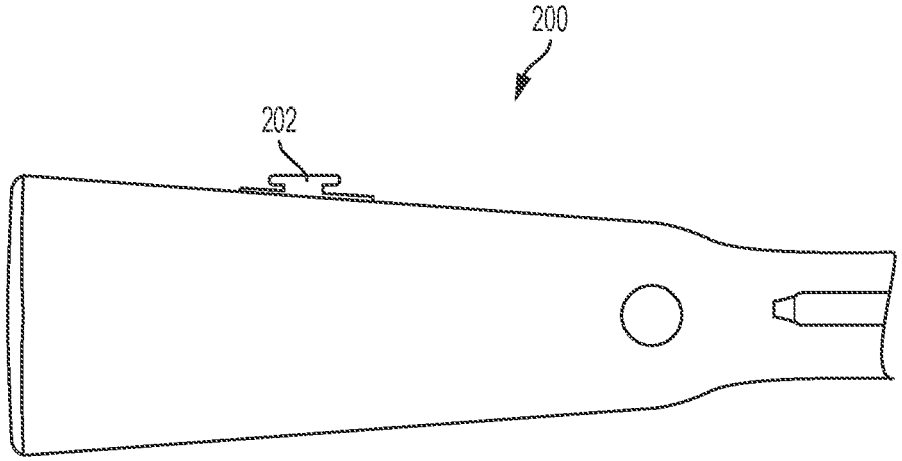
FIG. 10 is a schematic bottom view of the stock unit of FIG. 8 in an extended configuration.
Figure 11:
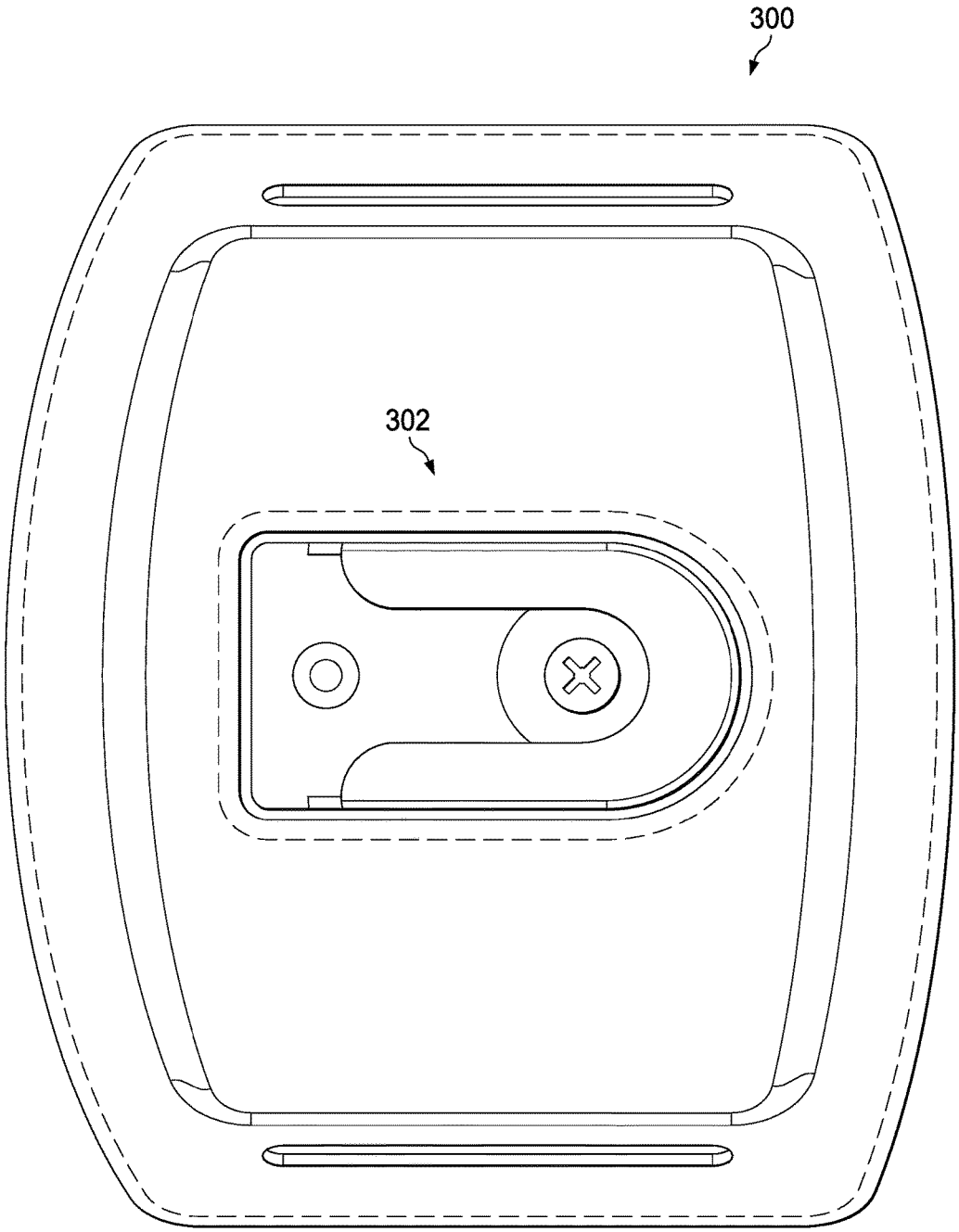
FIGS. 11-12 are views of an alternative embodiment of a belt unit according to an embodiment of the disclosure.
Figure 12:
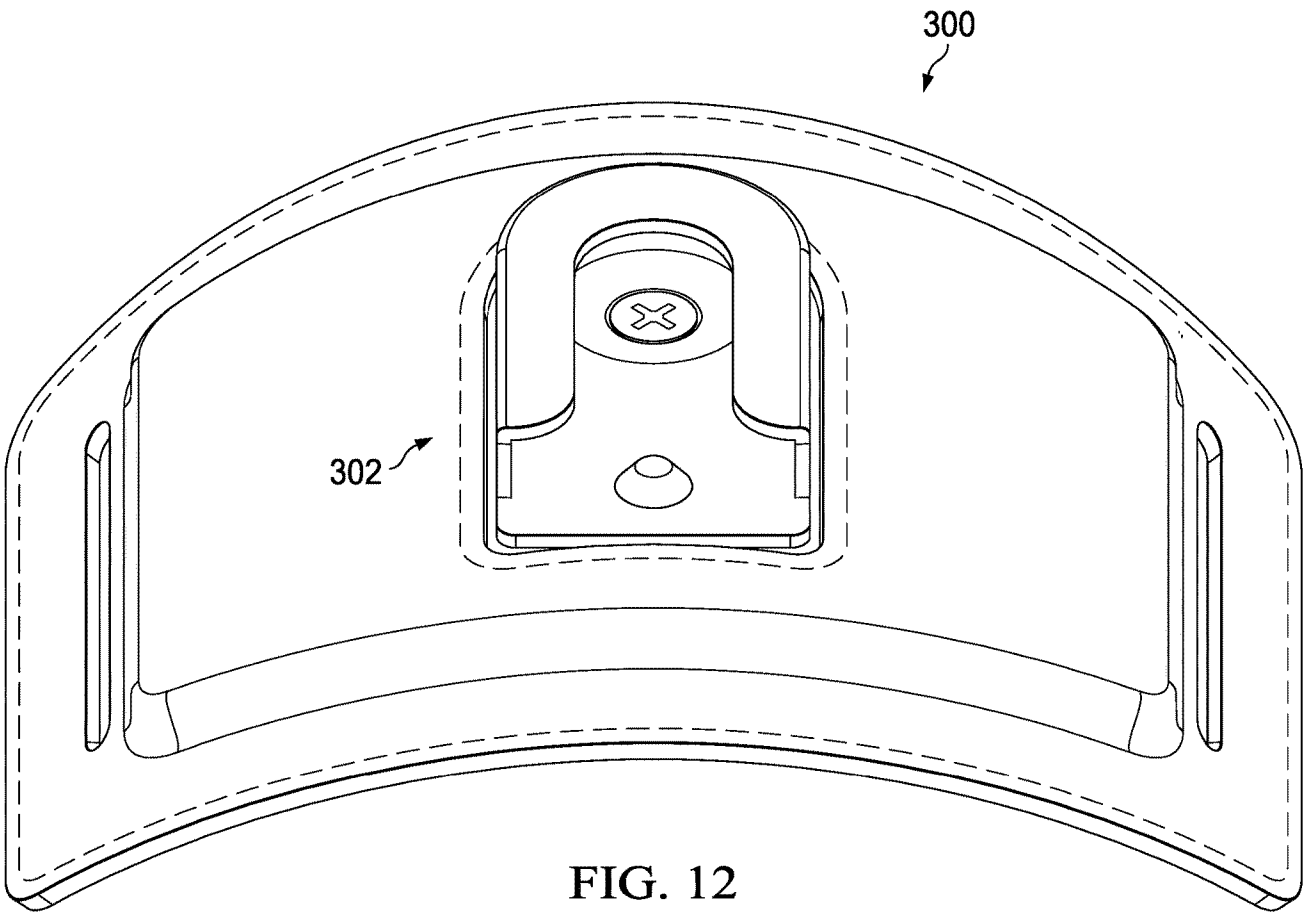
Figure 13:
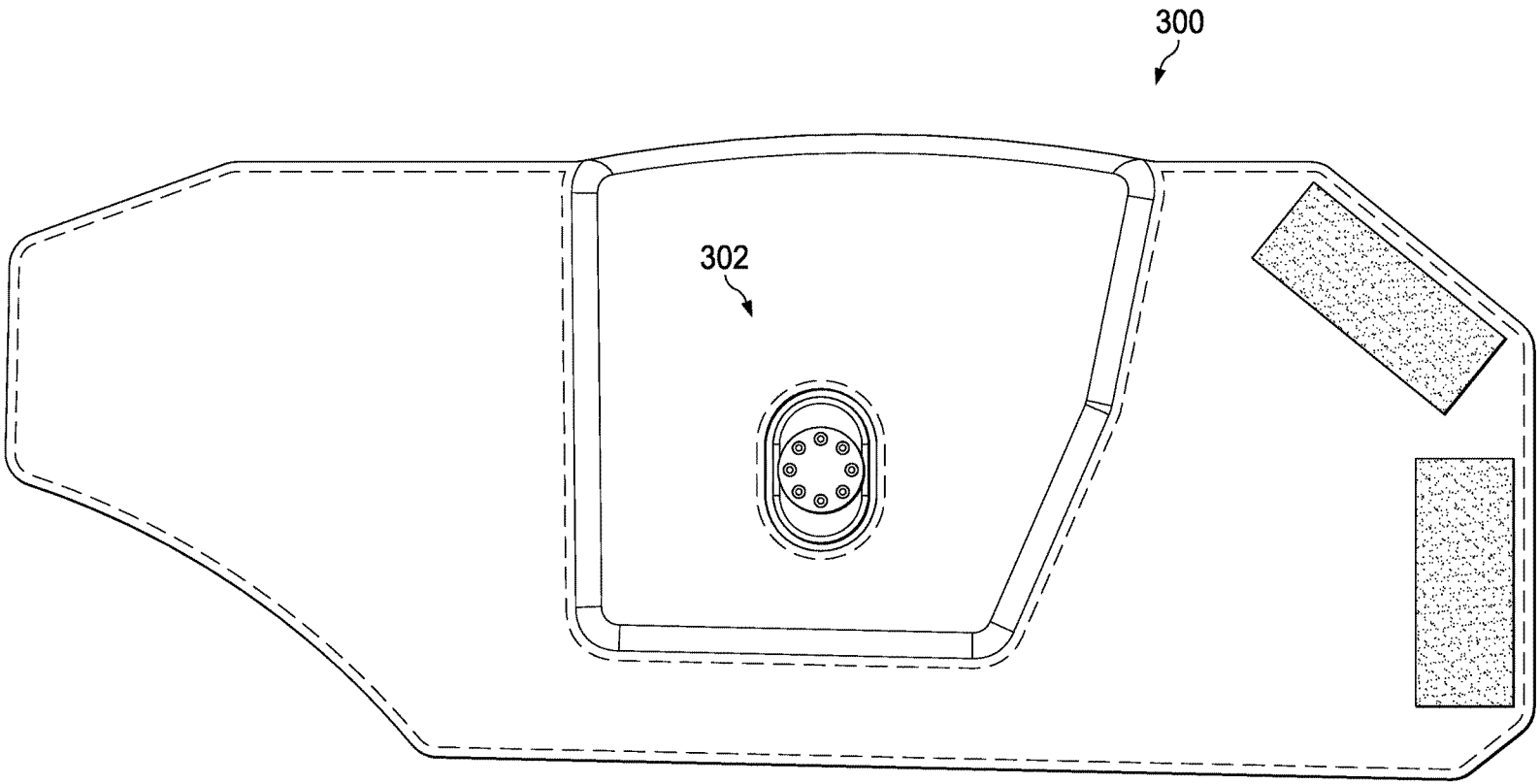
FIGS. 13-15 are views of an alternative embodiment of a stock unit according to an embodiment of the disclosure.
Figure 14:
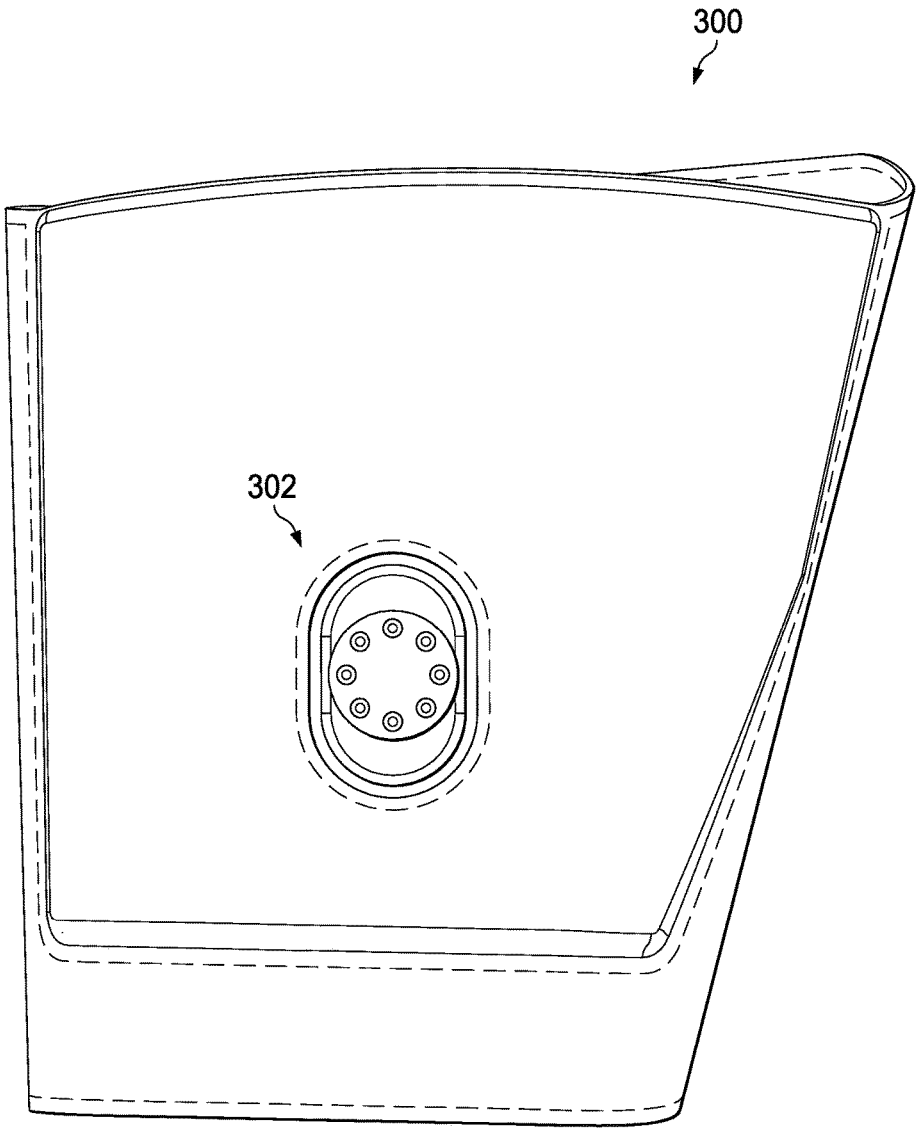
Figure 15:
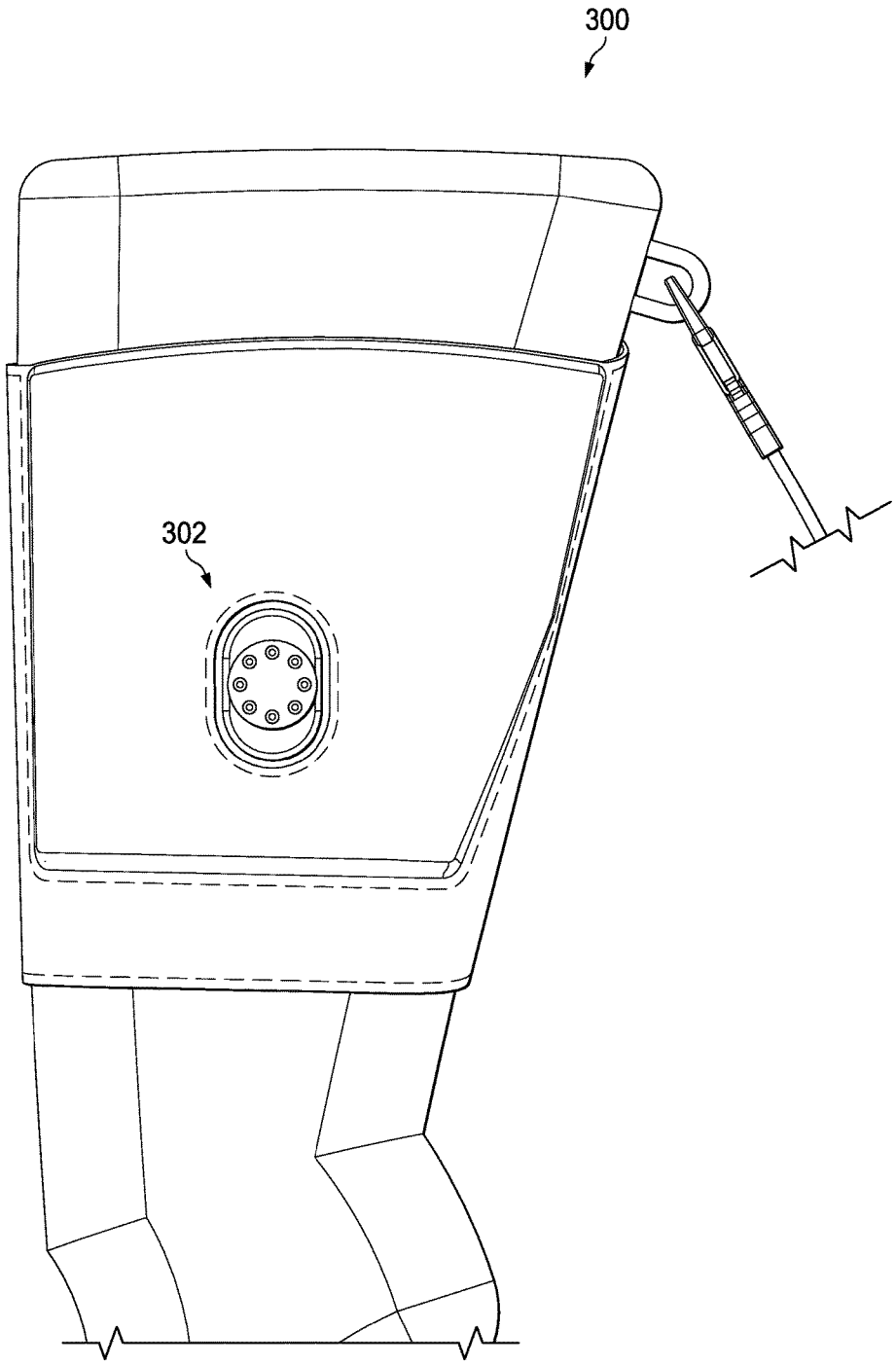
Figure 16:
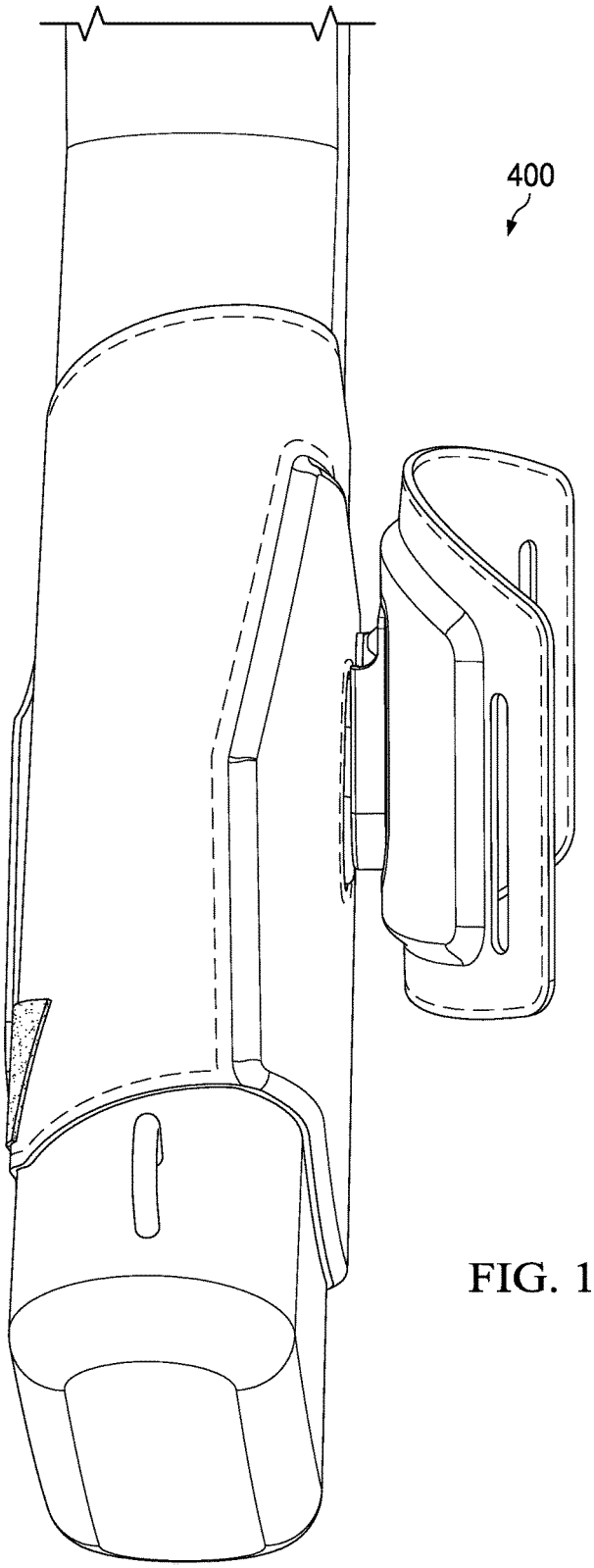
FIGS. 16-19 are views of an alternative embodiment of a firearm support system in an assembled configuration.
Figure 17:
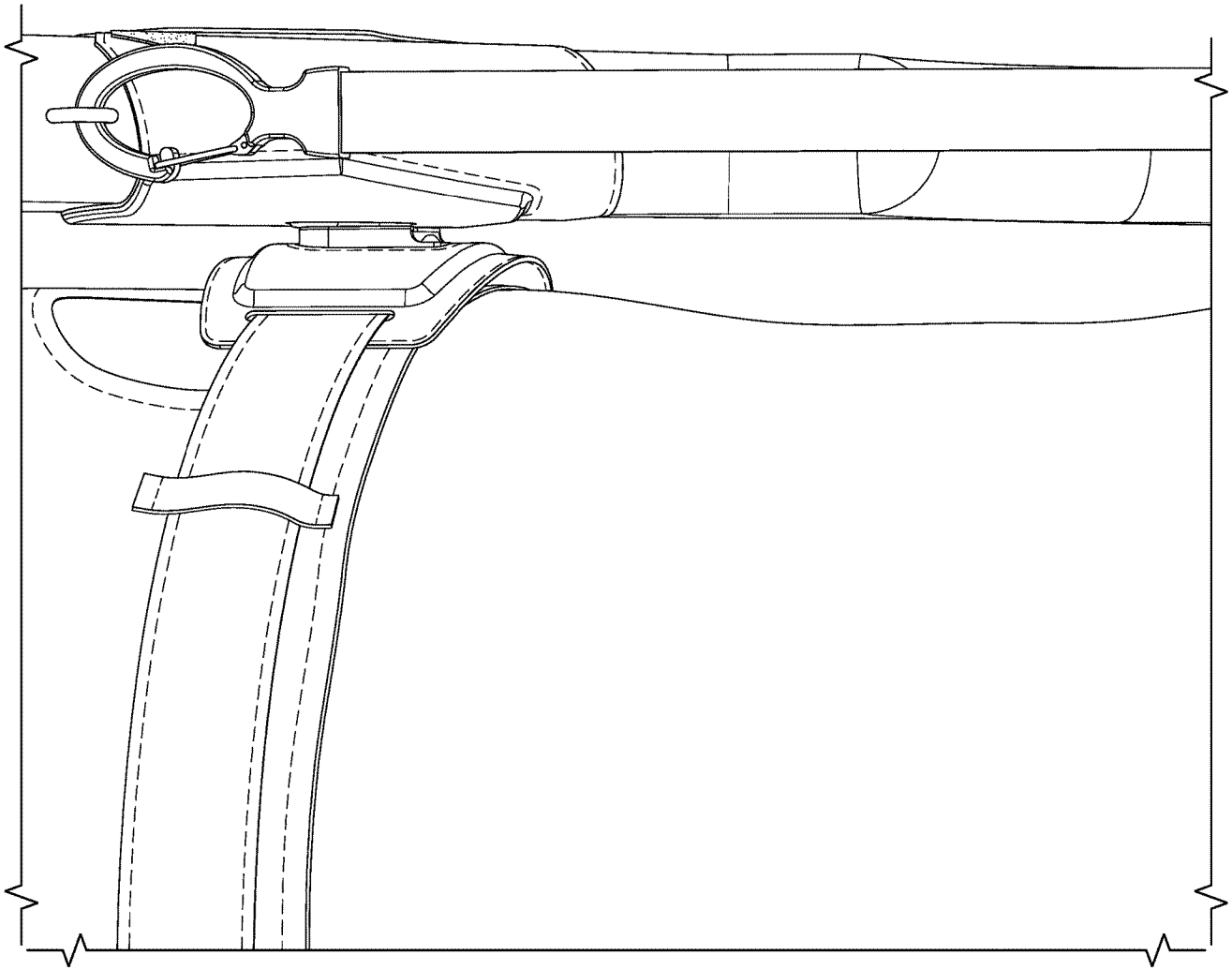
Figure 18:
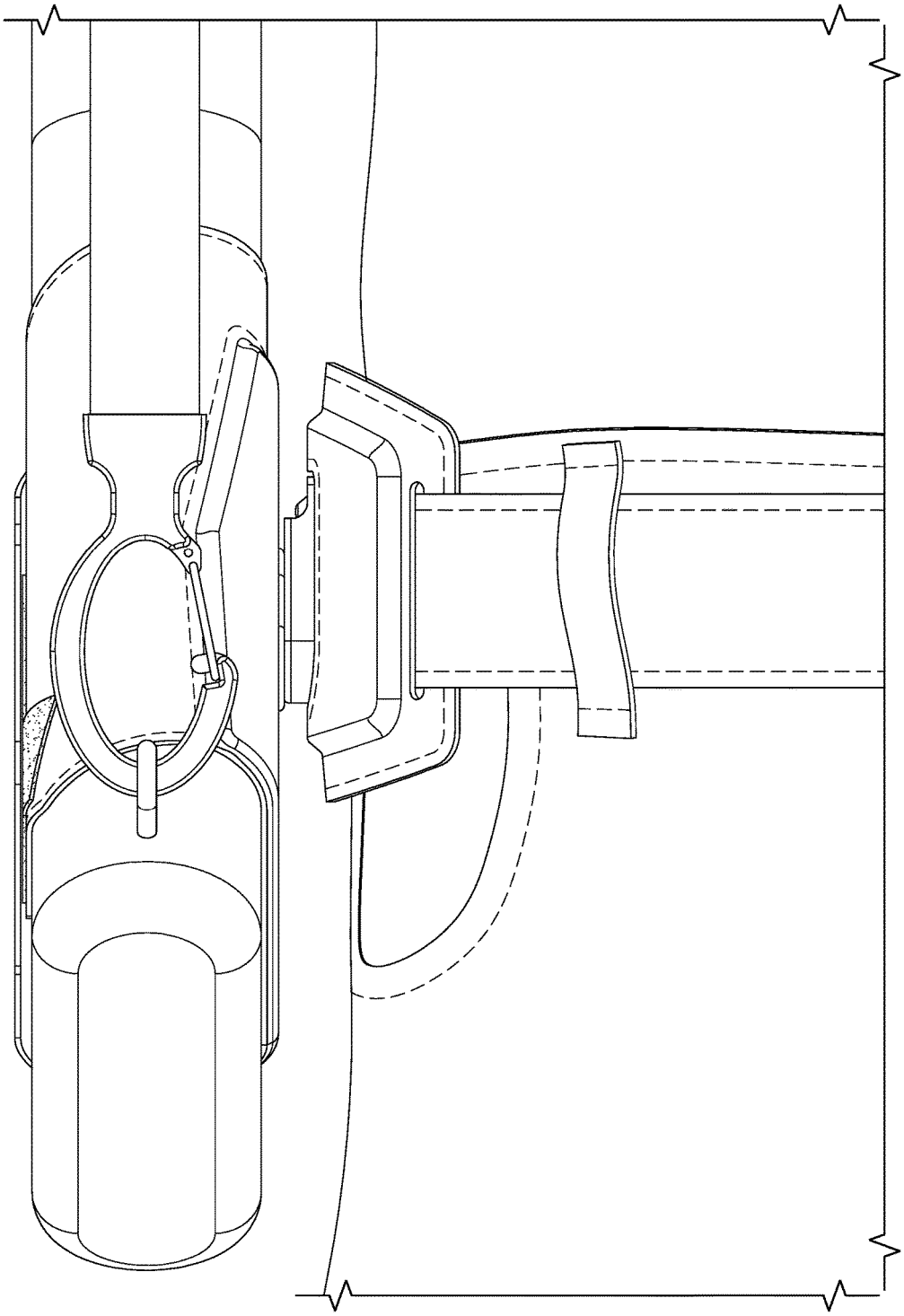
Figure 19:
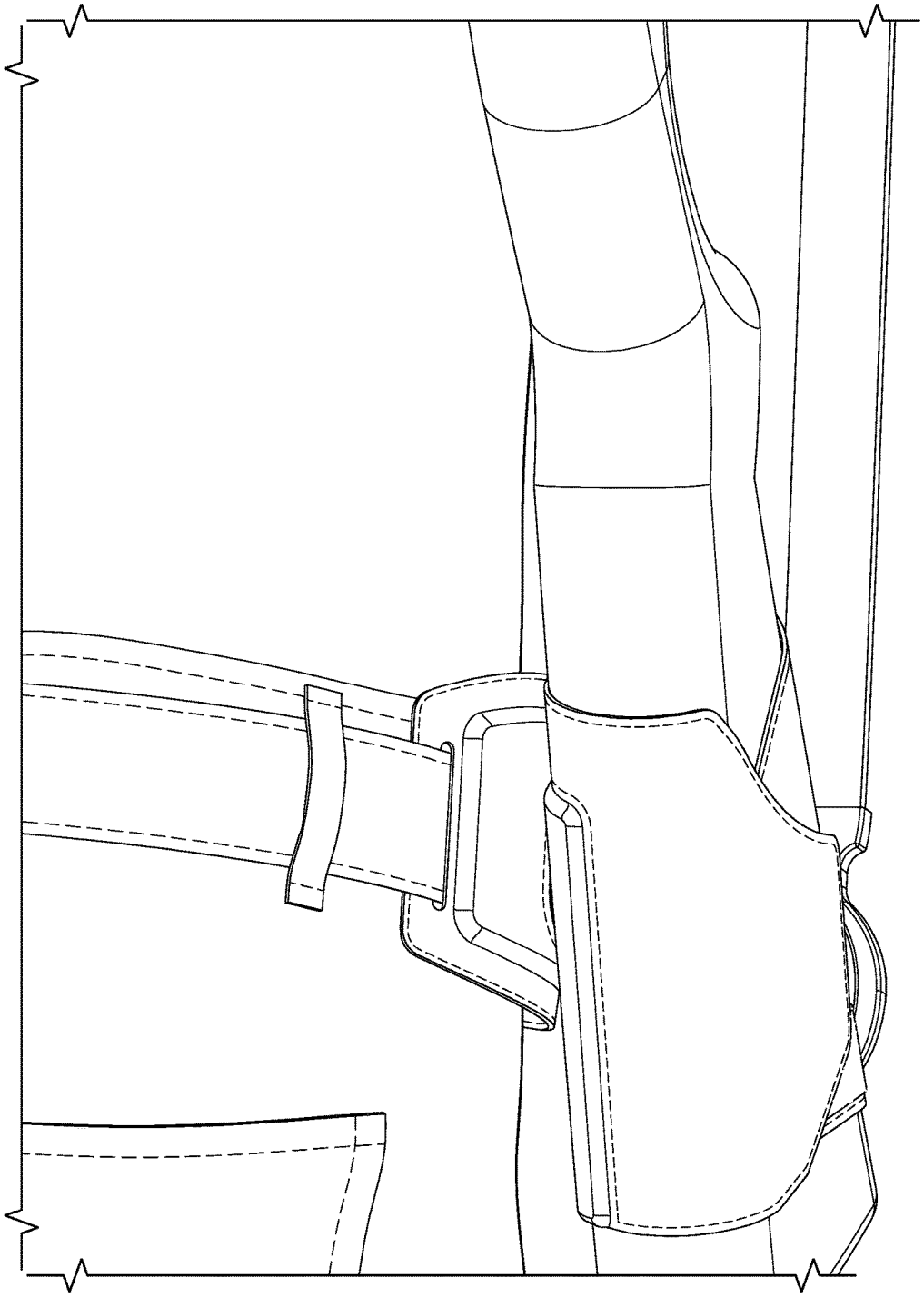
Figure 20A:
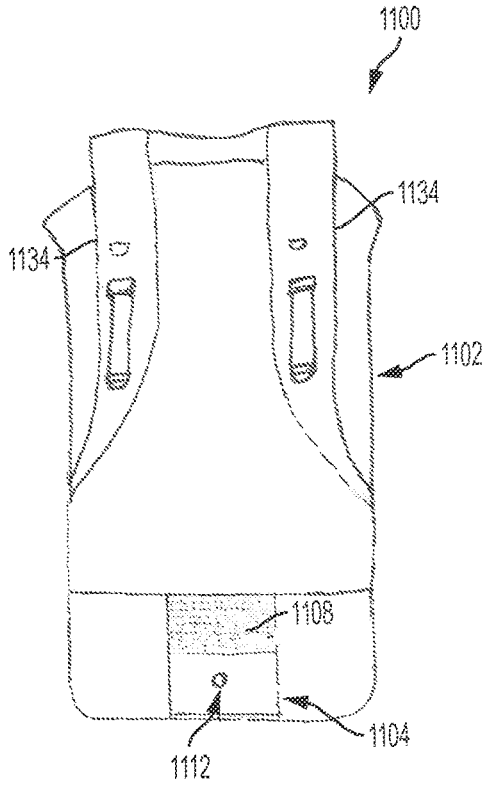
FIG. 20A is an orthogonal front view of a backpack of a backpack support system according to an embodiment of the disclosure.
Figure 20B:
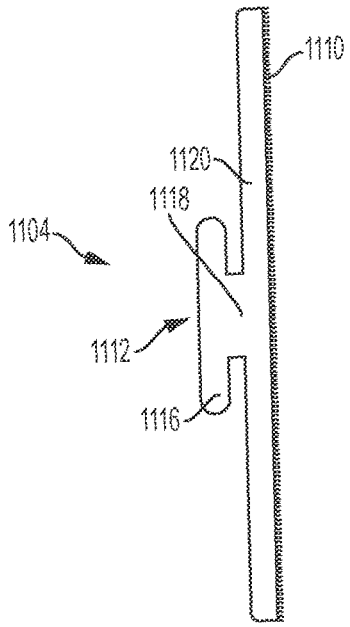
FIG. 20B is an orthogonal side view of a knuckle plate unit of the backpack support system of FIG. 20A, the knuckle plate unit being configured for selective attachment to the backpack of FIG. 20A.
Figure 21A:
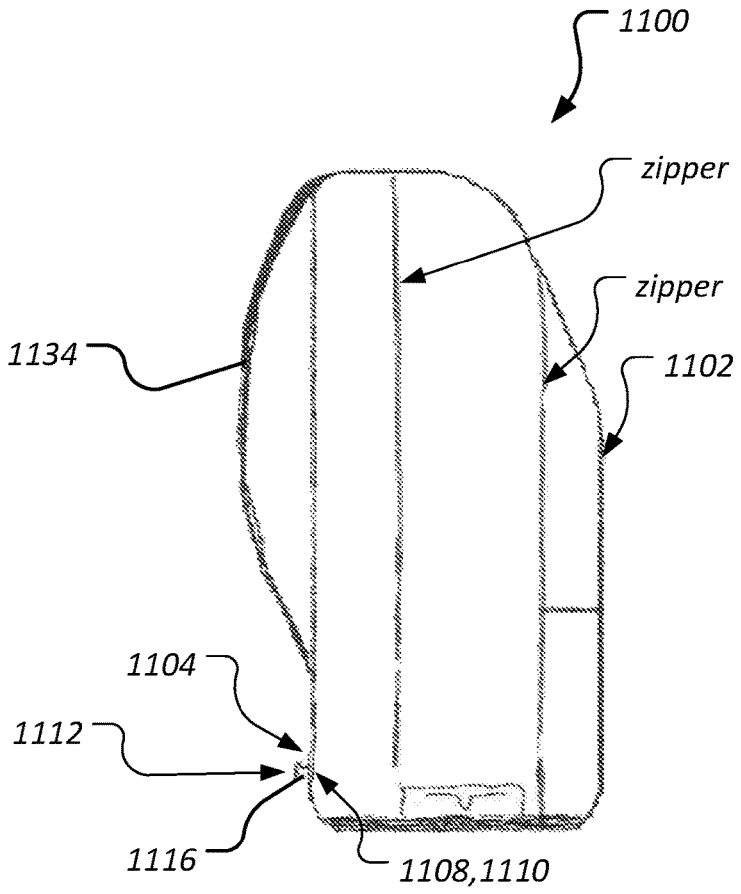
FIG. 21A is an orthogonal side view of the backpack support system of FIG. 20A in a partially assembled state with the knuckle plate unit of FIG. 20B removably connected to the backpack of FIG. 20A.
Figure 21B:
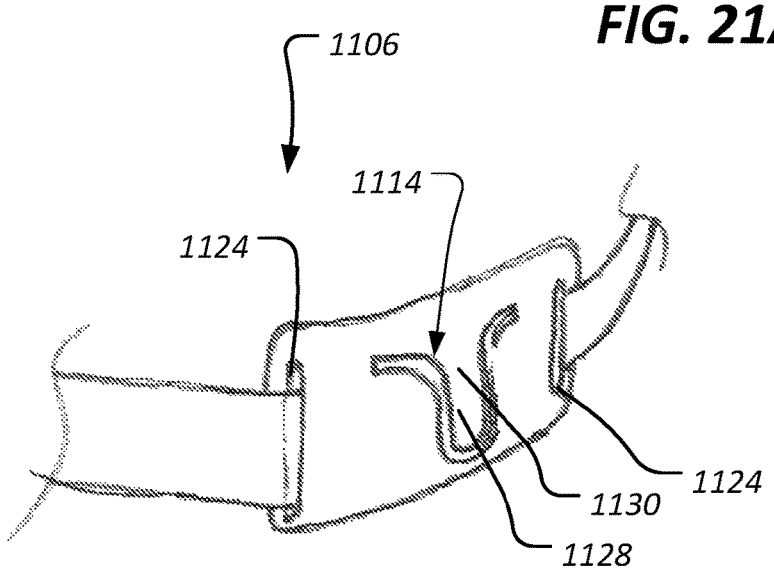
FIG. 21B is an oblique rear view of a belt unit of the backpack support system of FIG. 20A, the belt unit being removably connected to a belt.
Figure 22A:
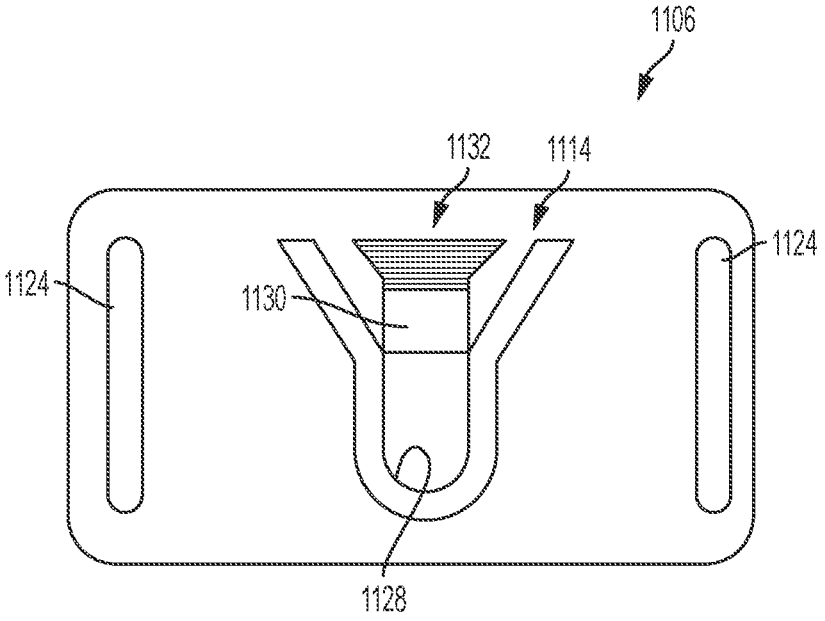
FIG. 22A is a detailed orthogonal rear view of the belt unit of FIG. 21B, the belt unit being shown in isolation.
Figure 22B:
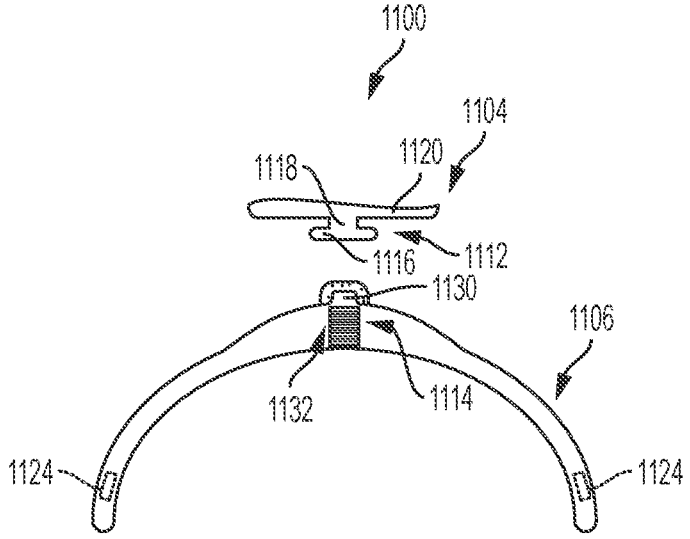
FIG. 22B is an orthogonal top view of the belt unit of FIG. 21B, the belt unit being shown in isolation.

Referring now to FIGS. 8-10, in an alternative embodiment, the male part of the stock unit is built into the stock itself, making the neoprene material unnecessary. The male part (knuckle) would not be engaged (or extended) from the stock until the user pressed the spring loaded male part to extent it past the surface of the stock. The weapon could then be used to attach to the belt unit. The user may then press the male part back into the stock and it would retract and lock back into place, flush with the unit. This embodiment could be part of the manufacturing process and built into the stock when manufactured of it can added on to the stock as an aftermarket accessory.

Referring now to FIGS. 20A-23B, a backpack support system 1100 is disclosed as comprising a backpack 1102, a knuckle plate unit 1104, and a belt unit 1106. The backpack 1102 comprises a first complementary component 1108. The knuckle plate unit 1104 comprises a second complementary component 1110 that is configured for selective engagement with the first complementary component 1108. The knuckle plate unit 1104 further comprises a third complementary component 1112 that is configured for selective engagement with a fourth complementary component 1114 of the belt unit 1106.

In this embodiment, the first complementary component 1108 comprises an area of a first type of hook and loop fastener material, such as, but not limited to, Velcro hook material, located on an exterior front surface of the backpack 1102 and generally configured so that when the backpack 1102 is worn by a user, the first complementary component 1108 is located on or about an innermost lower middle section of the backpack 1102. The lower middle section of the backpack 1102 generally faces the user's back when the backpack 1102 is in use.

In this embodiment, the second complementary component 1110 of the knuckle plate unit 1104 comprises an area of a second type of hook and loop fastener material, such as, but not limited to, Velcro loop material, located on an exterior rear surface of the knuckle plate unit 1104 and generally configured so that when the backpack support system 1100 is in use the second complementary component 1110 is removably attached to the first complementary component 1108. In some embodiments, a strength of the removable connection between the first complementary component 1108 and the second complementary component 1110 is sufficient to bear the weight of the backpack 1102 and contents of the backpack 1102 without substantially compromising the connection between the first complementary component 1108 and the second complementary component 1110. Generally, the knuckle plate unit 1104 may be pressed against the backpack 1102 to join the first complementary component 1108 to the backpack 1102.

In some embodiments, the third complementary component 1112 of the knuckle plate unit 1104 comprises a raised knuckle, button, and/or other suitable male component and/or protrusion. In some embodiments, the third complementary component 1112 comprises a rounded head 1116 carried by a central shaft 1118 that may extend form and/or be integrally molded with a semi-ridged plastic body 1120.

In this embodiment, the fourth complementary component 1114 of the belt unit 1106 is generally configured to selectively receive, capture, and/or retain the third complementary component 1112 of the knuckle plate unit 1104. In some embodiments, the fourth complementary component 1114 comprises a generally U-shaped channel configured to receive at least a portion of the head 1116 and/or shaft 1118. In some embodiments, one or more portions of the belt unit 1106 may comprise a size of approximately 4" long by 1.5"-2" wide with belt openings 1124 near ends of the belt unit 1106. The belt openings 1124 may be configured to receive a belt 1126 therethrough to carry the belt unit 1106 at or near a waist or hip area of the user. The knuckle plate unit 1104, while attached to backpack 1102, may be attached to the belt unit 1106 using the fourth complementary component 1114 and/or the belt unit 1106 may alternatively be formed integrally with and/or permanently attached to the belt 1126. The fourth complementary component 1114 may comprise a long vertical slot 1128 and an interior channel 1130 collectively configured to receive the shaft 1118 and the head 1116, respectively. The knuckle plate unit 1104 may be selectively held in place relative to the belt unit 1106 by a tab/rail system 1132 as a function of one or both of friction between the rail system 1132 and the head 1116 and the weight of the backpack 1102 forcing the shaft 1118 downward within the slot 1128. The weight of the backpack 1102 transferred to the joined area of the belt unit 1106 and the knuckle plate unit 1104 may be regulated by variations in the placement of the knuckle plate unit 1104 on backpack 1102 as well as by the amount of tension applied via backpack straps 1134 associated with a user's shoulders. The less tension on the backpack straps 1134, the more weight is transferred to the belt 1126 via the connection between the belt unit 1106 and the knuckle plate unit 1104. The backpack support system 1100 may allow the backpack 1102 to be secured to the user via a 3 point attachment system, namely, the two backpack straps 1134 around the shoulders and the backpack support system 1100 via the belt 1126. The backpack support system 1100 may aid in stabilizing and transporting a backpack 1102.

In some embodiments, the backpack 1102 may comprise any suitable material, shape, and/or design. In some embodiments, the backpack 1102 may comprise a Velcro strip area permanently attached on the outside of the backpack 1102 at or near the innermost lower middle section of backpack 1102. The Velcro strip may face the small of the back of a user when the backpack 1102 is worn by a user. The Velcro strip may comprise an area of approximately 4" wide (approximate width of some embodiments of the knuckle plate unit 104) by 10"-12" long in a vertical direction. In some cases, the Velcro strip may extend upward from a lowest portion of the back of the backpack 1102. The Velcro strip may allow the user to place the knuckle plate unit 1102 anywhere on the Velcro strip area, thereby allowing for a customized fit and improved regulation of weight distribution when the knuckle plate unit 1104 is engaged to a belt unit 1106.

Figure 23A:
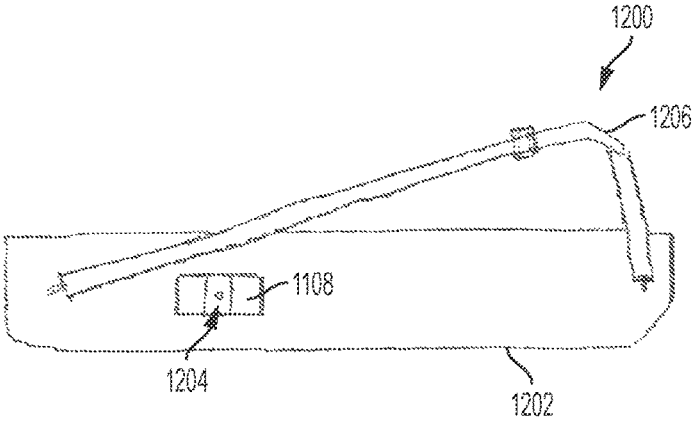
FIG. 23A is an orthogonal rear view of an alternative embodiment of a support system comprising a knuckle plate unit attached to a scabbard.
Figure 23B:
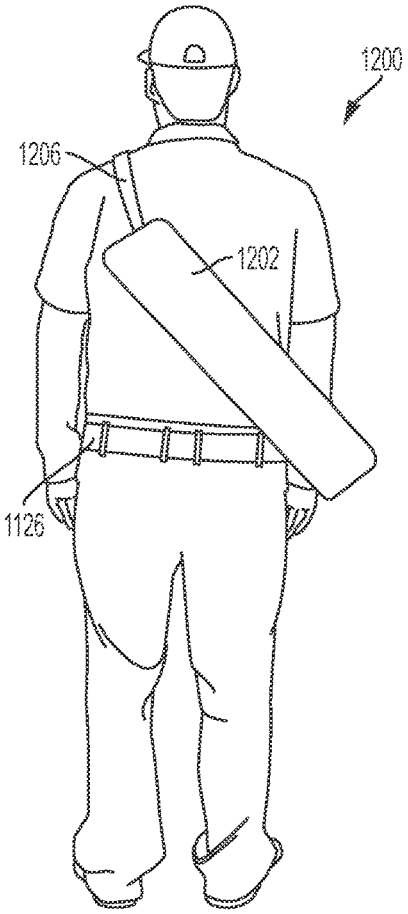
FIG. 23B is an orthogonal rear view the support system of FIG. 23A, the knuckle plate unit being attached to a belt unit and the belt unit being attached to a belt.

Referring now to FIGS. 23A and 23B, an embodiment of an object support system 1200 is shown. In this embodiment, the object support system 1200 generally comprises a scabbard 1202, a knuckle plate unit 1204, and a belt unit. In this embodiment, the knuckle plate unit 1204 and the belt unit are substantially similar to the knuckle plate unit 1104 and the belt unit 1106, respectively. In this embodiment, the scabbard 1202 (or other object) may be at least partially supported by a sling 1206 using a sling method. In some cases, the knuckle plate unit 1204 may be formed by a plastic injection molding process that forms the knuckle, button, and/or male component or protrusion and the semi-ridged body as an integral unit. In some cases, the knuckle plate unit 1204 may comprise a size of approximately 3"-4" wide by 3"-4" long in a vertical direction and substantially the entire back may be covered with and/or carry Velcro material. The back of the knuckle plate unit 1204 may be selectively attached to complementary Velcro material carried on an exterior of the scabbard 1202.

Figure 24:
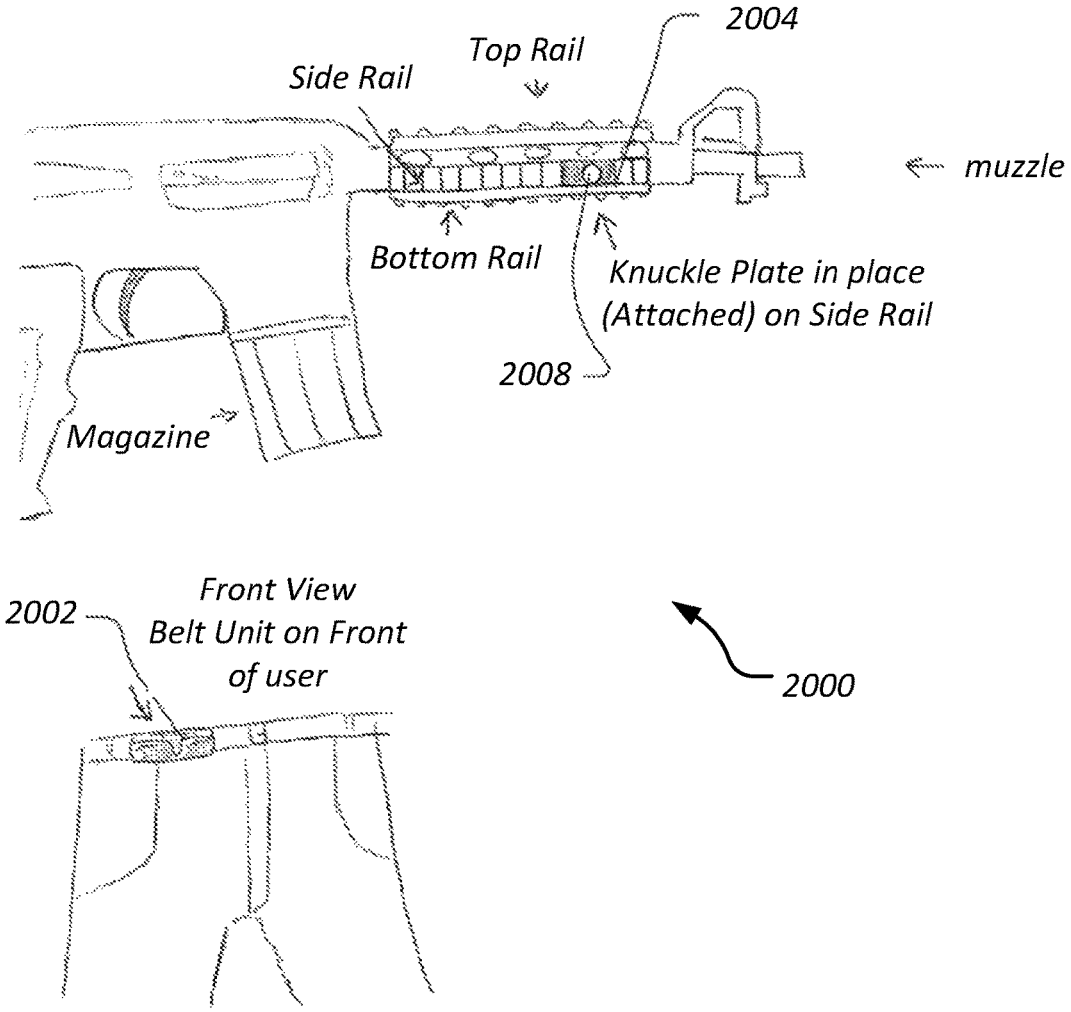
FIGS. 24-28 show various views of another support system.
Figure 25:
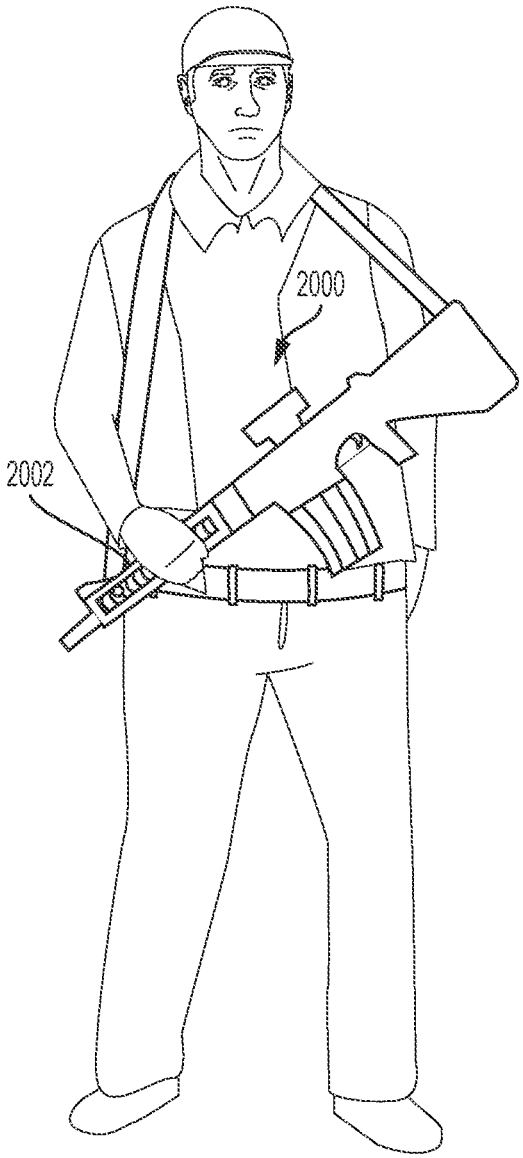
Figure 26:
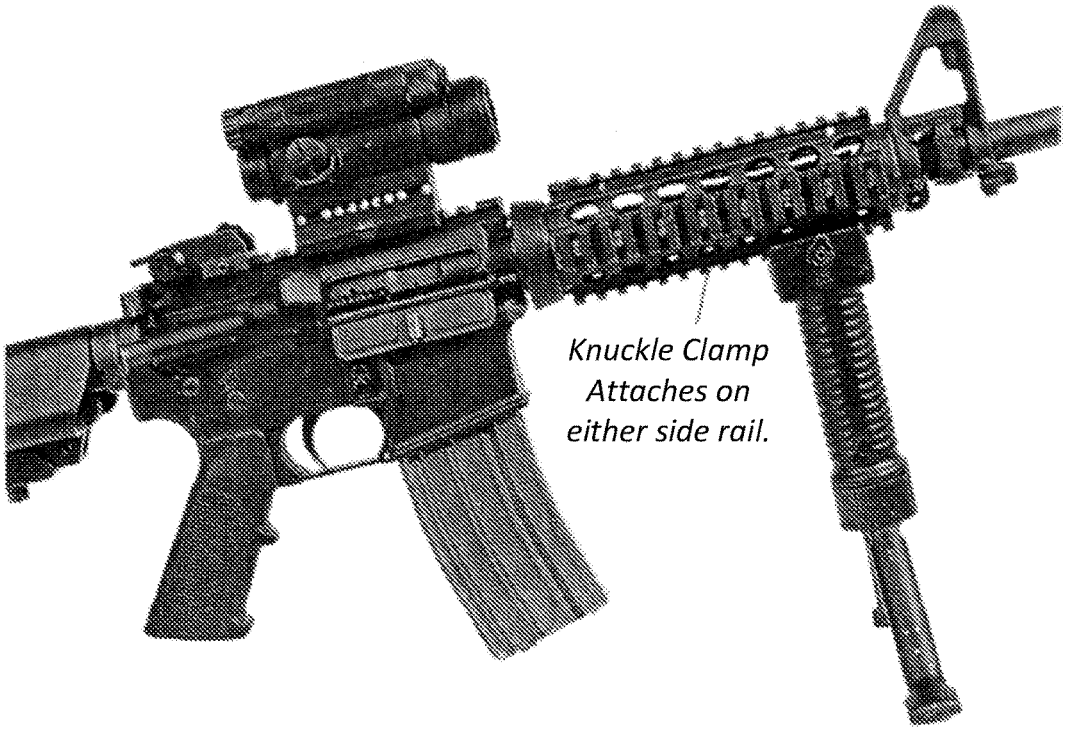
Figure 27:
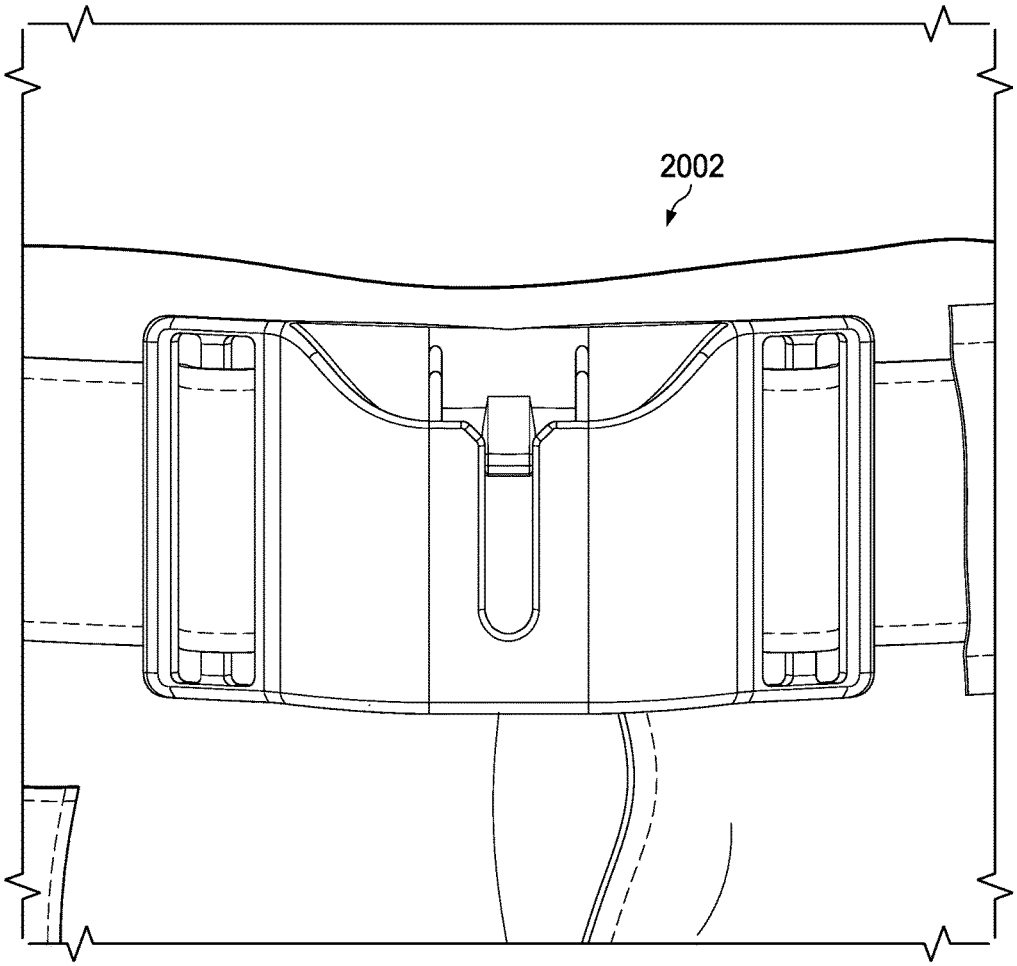

Referring now to FIGS. 24-28, an embodiment of a Picatinny Rail Weapon Support System (PRWSS) 2000 shown. FIG. 24 shows the PRWSS in an unassembled state and FIG. 25 shows the PRWSS in an assembled state. FIG. 26 shows a typical weapon comprising a plurality of rails compatible with the PRWSS 2000. The PRWSS 2000 comprises some of the same basic principles as the system 100. This system 2000 allows the user to adjust or transfer an adjustable amount of weight off of the user's shoulder area (when the weapon is being carried by sling over the shoulders) and deliver it to the user belt area via a two piece system comprising a belt unit 2002 and knuckle clamp 2004 that is configured for attachment to a rail such as a Picatinny rail of a rail system. FIG. 27 shows a close up view of a belt unit 2002.

Figure 28:
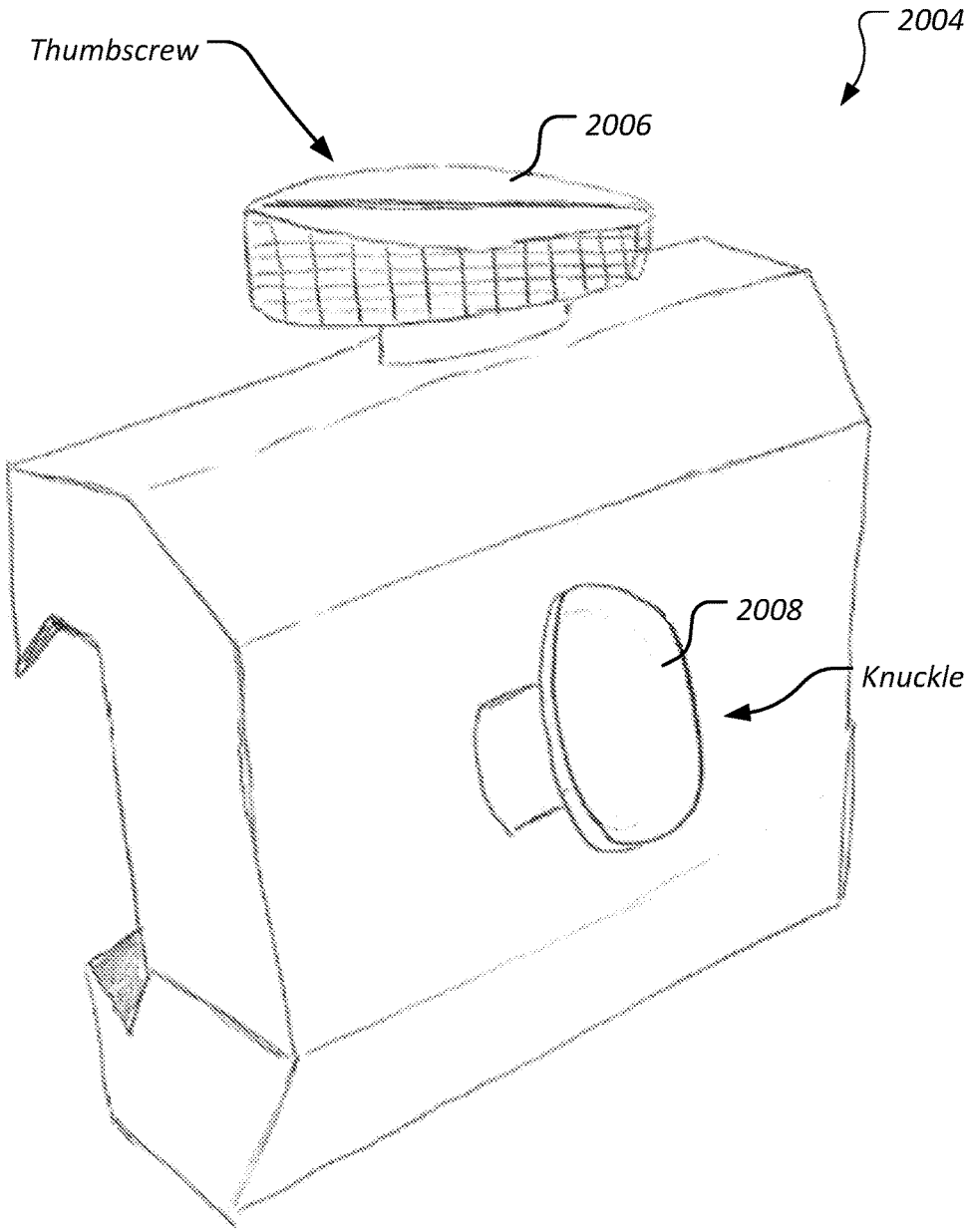
Figure 29:
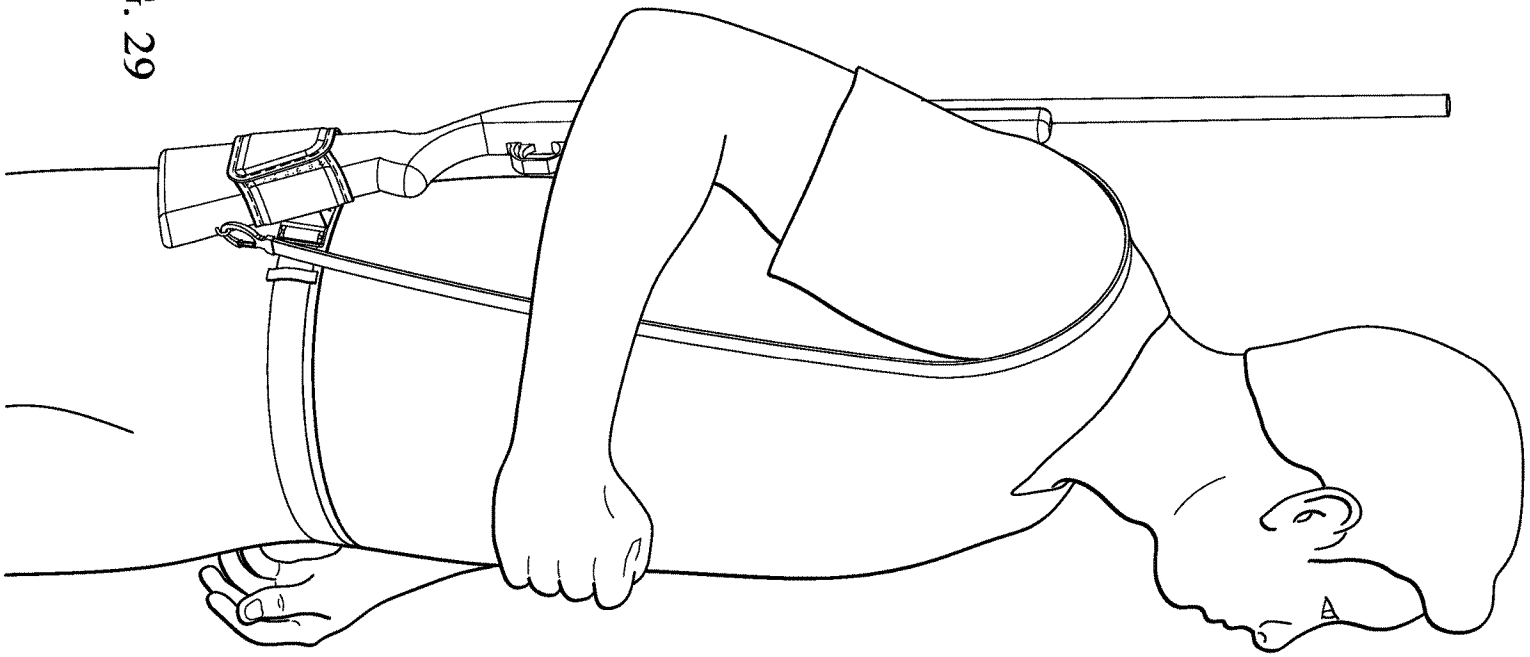
FIGS. 29-32 show various views of a support system in use with a weapon in a variety of positions relative to a user.
Figure 30:
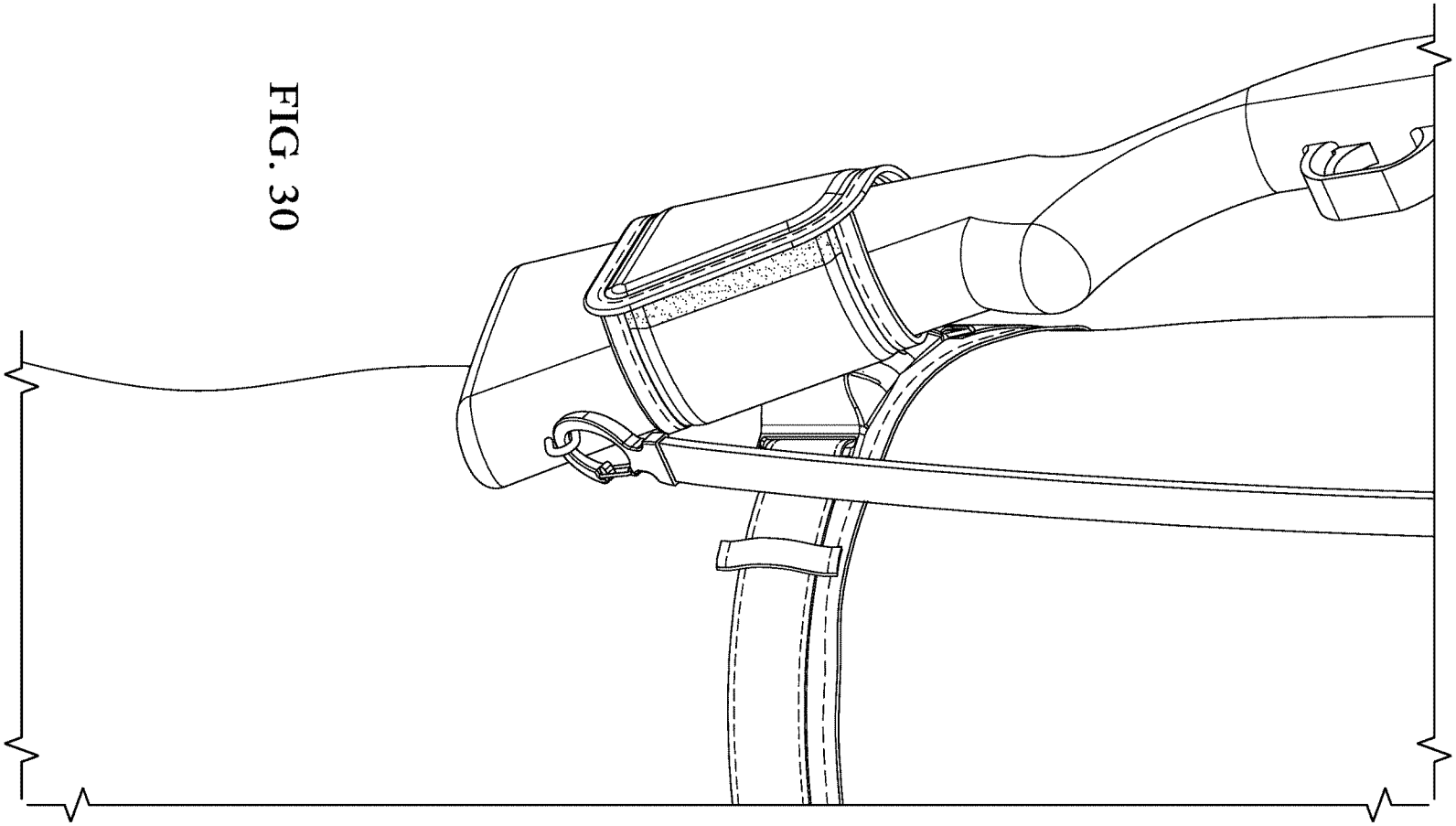
Figure 31:
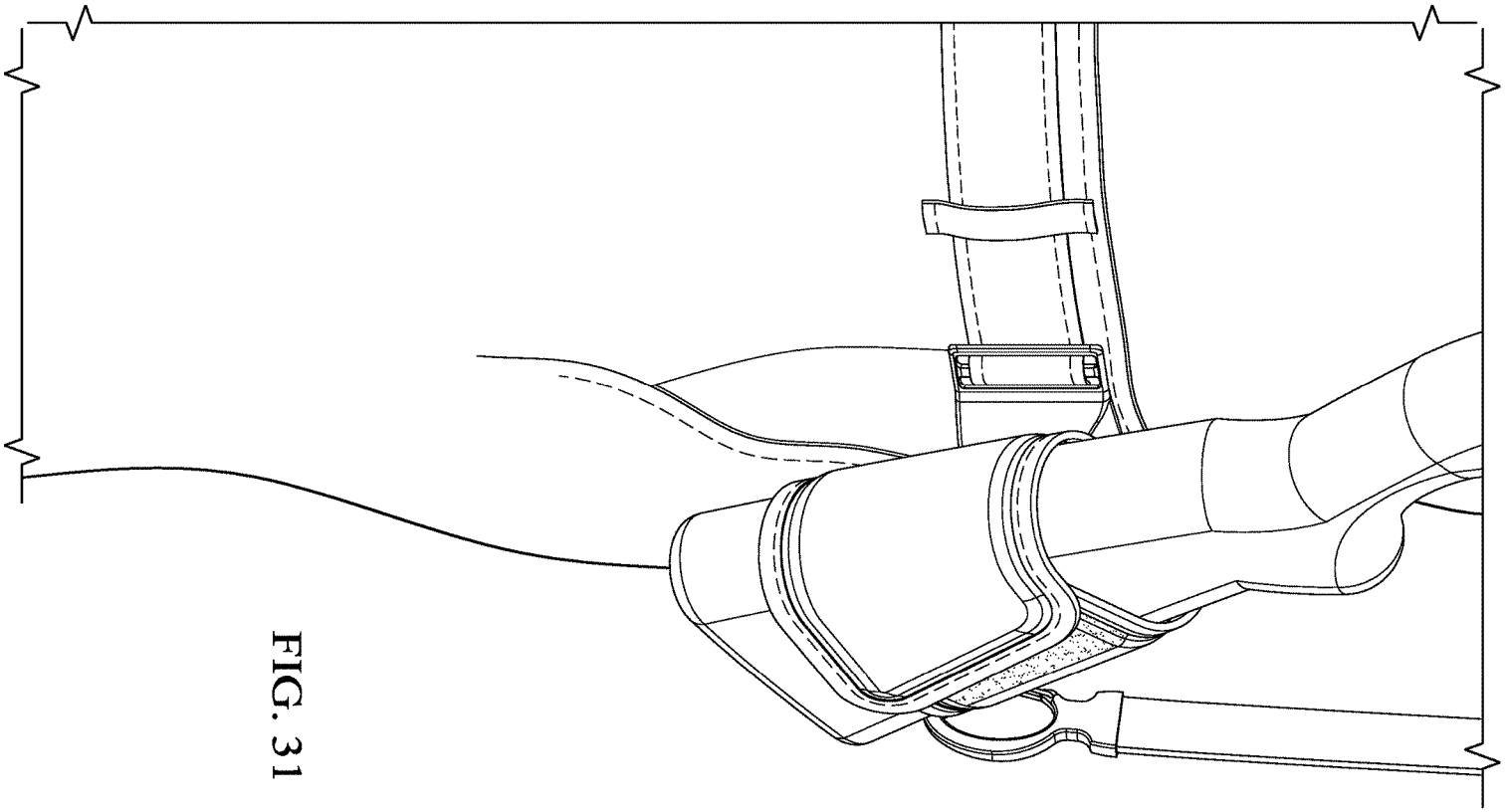
Figure 32:
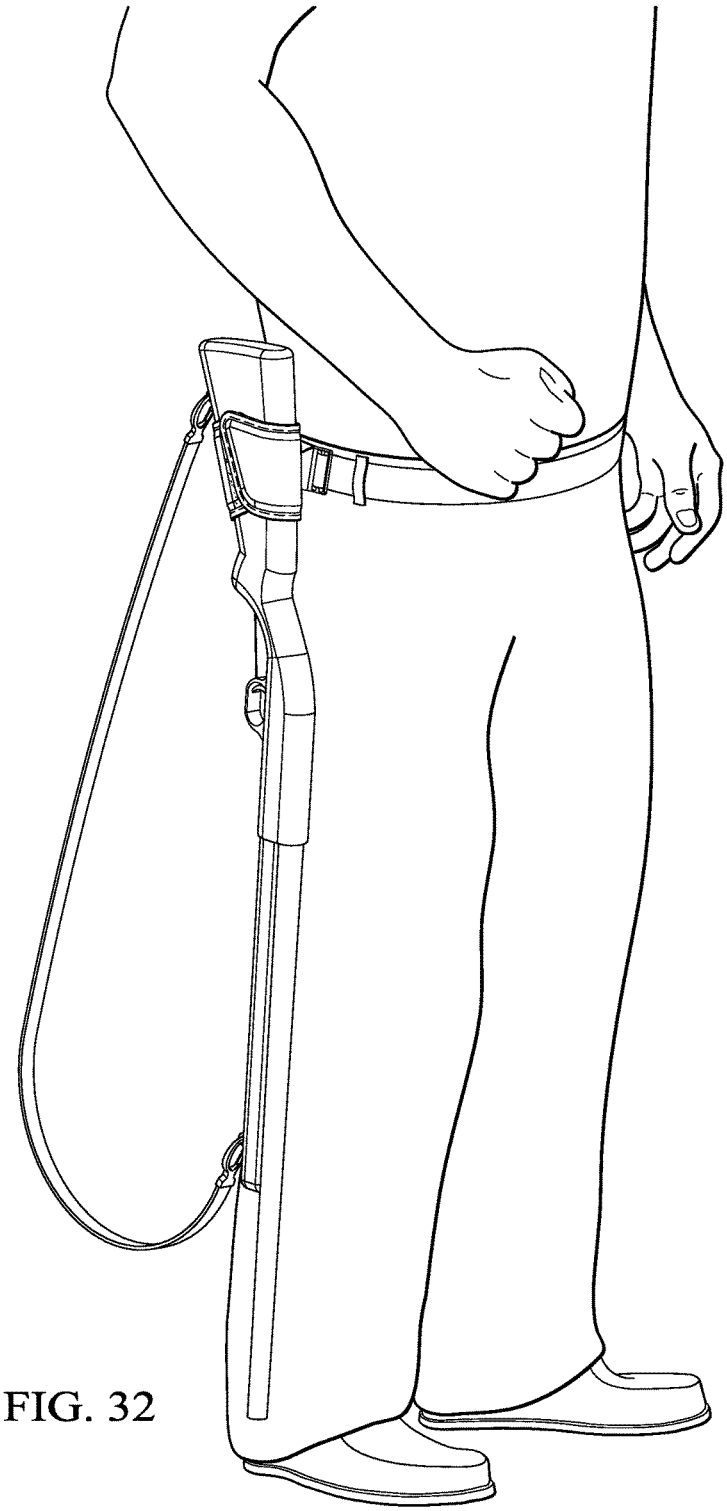
Figure 33:
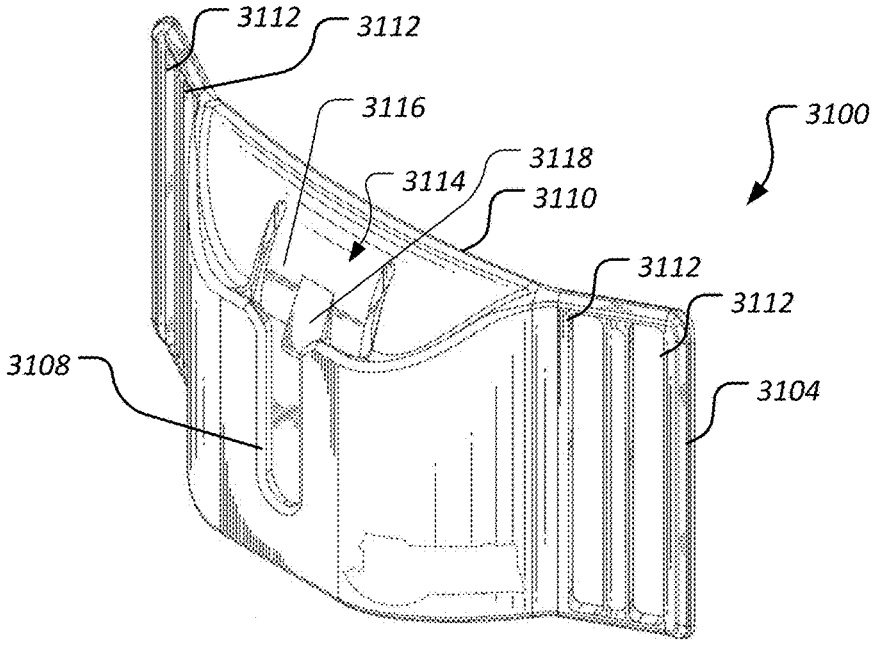
FIG. 33 is an oblique front right view of a belt unit of a firearm support system according to an embodiment of this disclosure.
Figure 34:
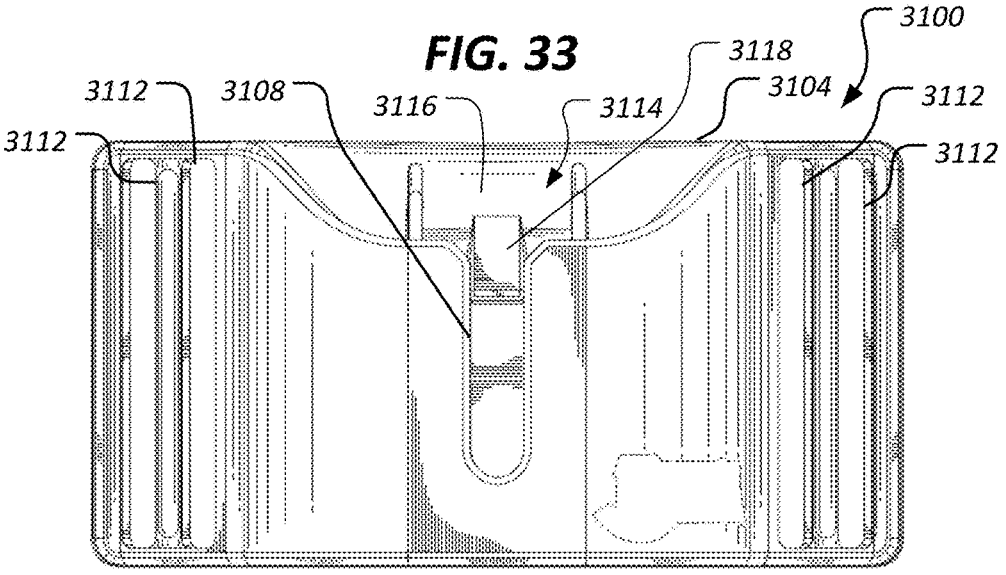
FIG. 34 is an orthogonal front view of the belt unit of FIG. 33.
Figure 35:
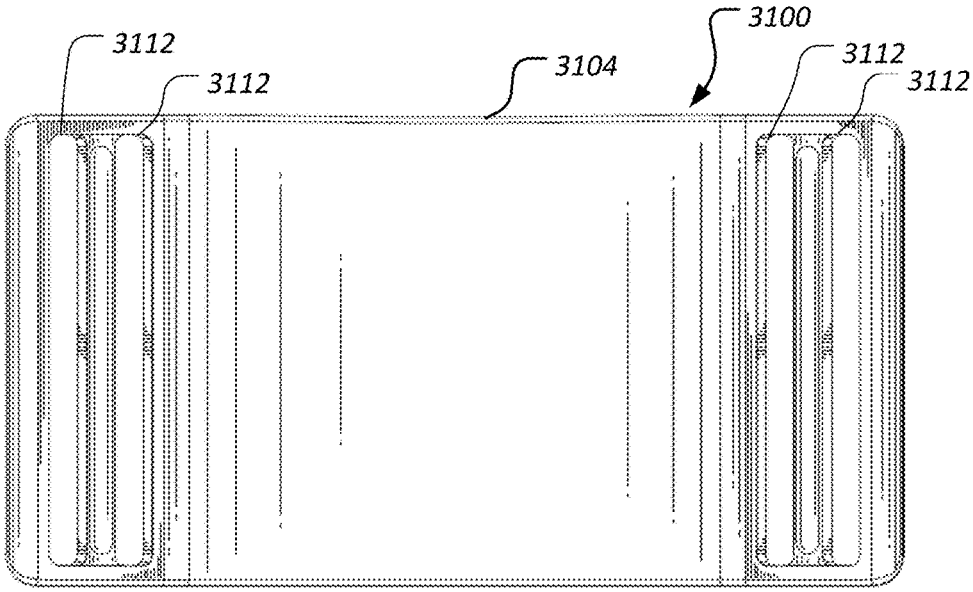
FIG. 35 is an orthogonal back view of the belt unit of FIG. 33.
Figures 36, 37:
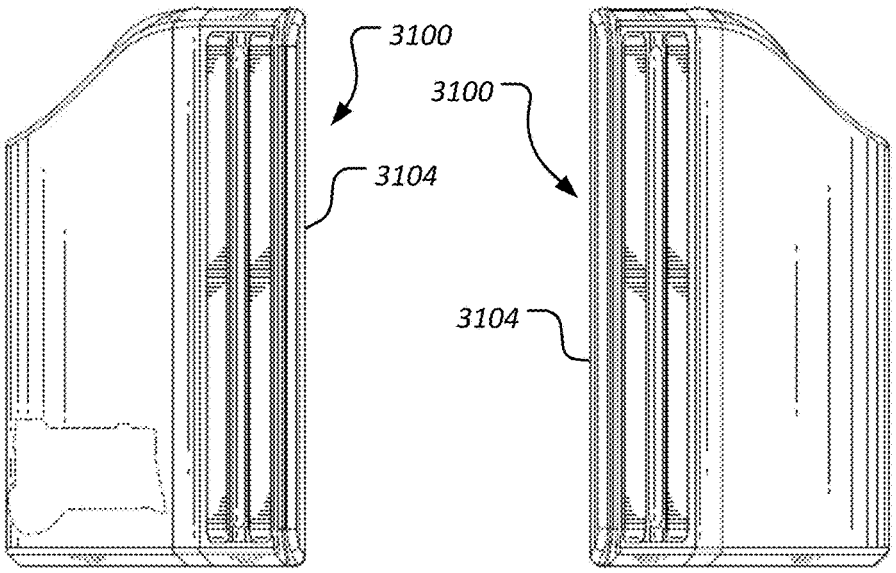
FIG. 36 is an orthogonal right view of the belt unit of FIG. 33.
FIG. 37 is an orthogonal left view of the belt unit of FIG. 33.
Figure 38:
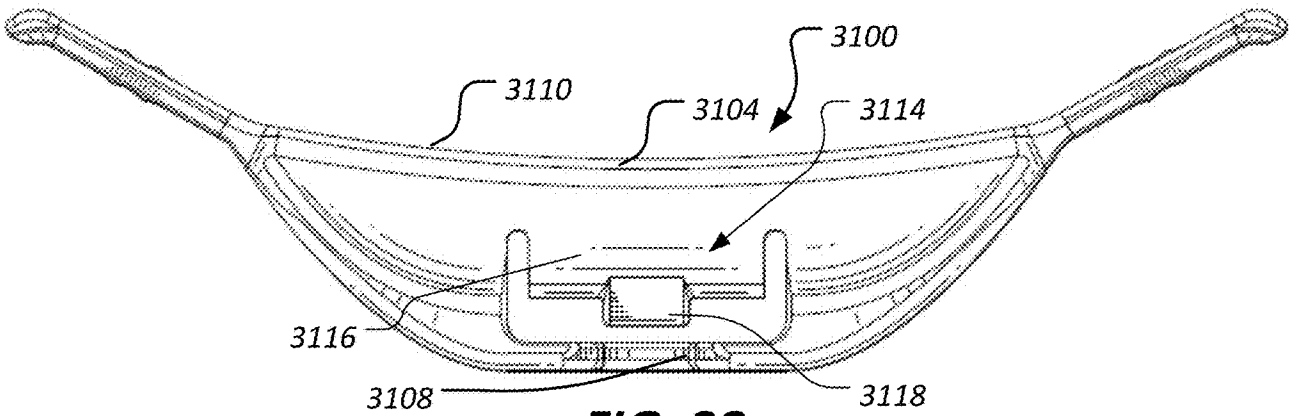
FIG. 38 is an orthogonal top view of the belt unit of FIG. 33.
Figure 39:
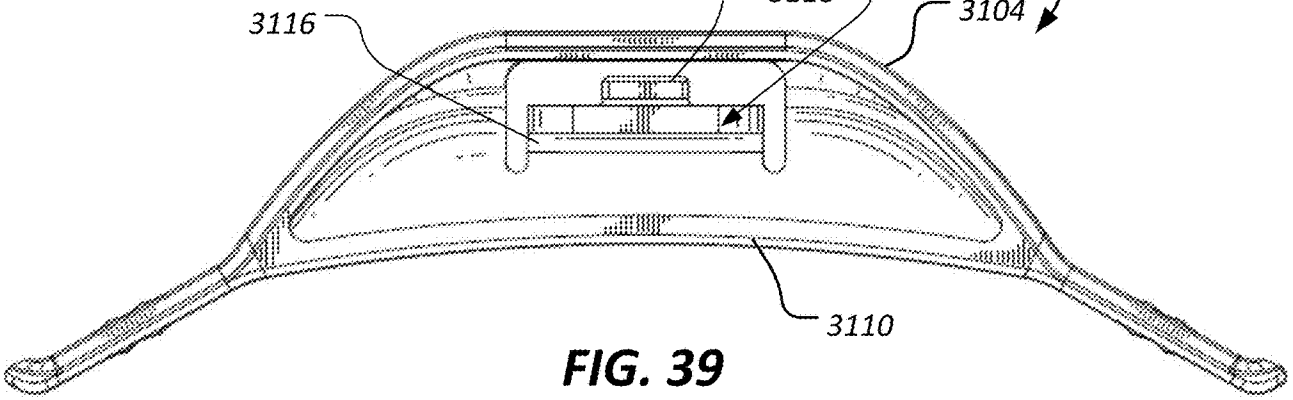
FIG. 39 is an orthogonal bottom view of the belt unit of FIG. 33.
Figure 40:
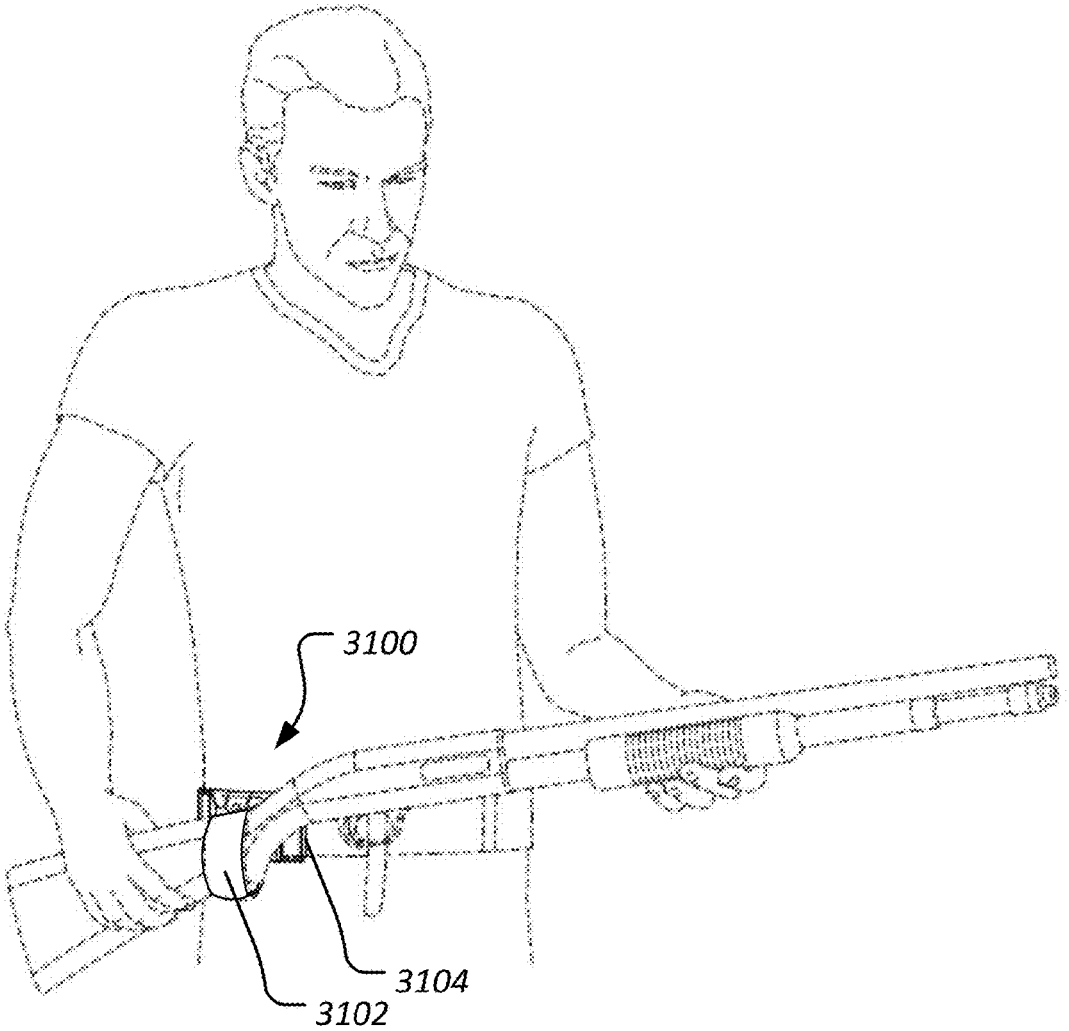
FIG. 40 is another oblique view of the firearm support system of FIG. 33.
Figure 41:
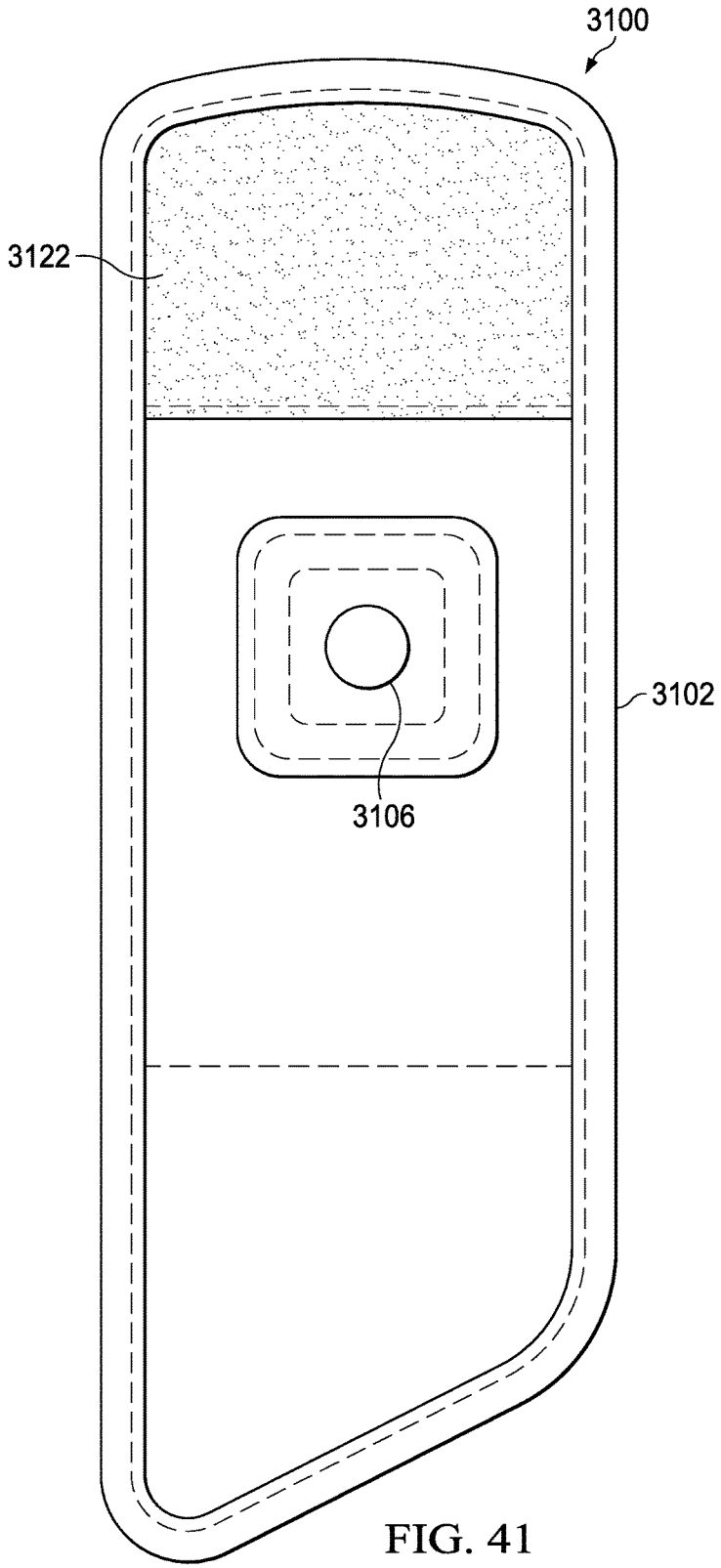
FIG. 41 is an orthogonal view of a stock unit of the firearm support system of FIG. 40.
Figure 42:
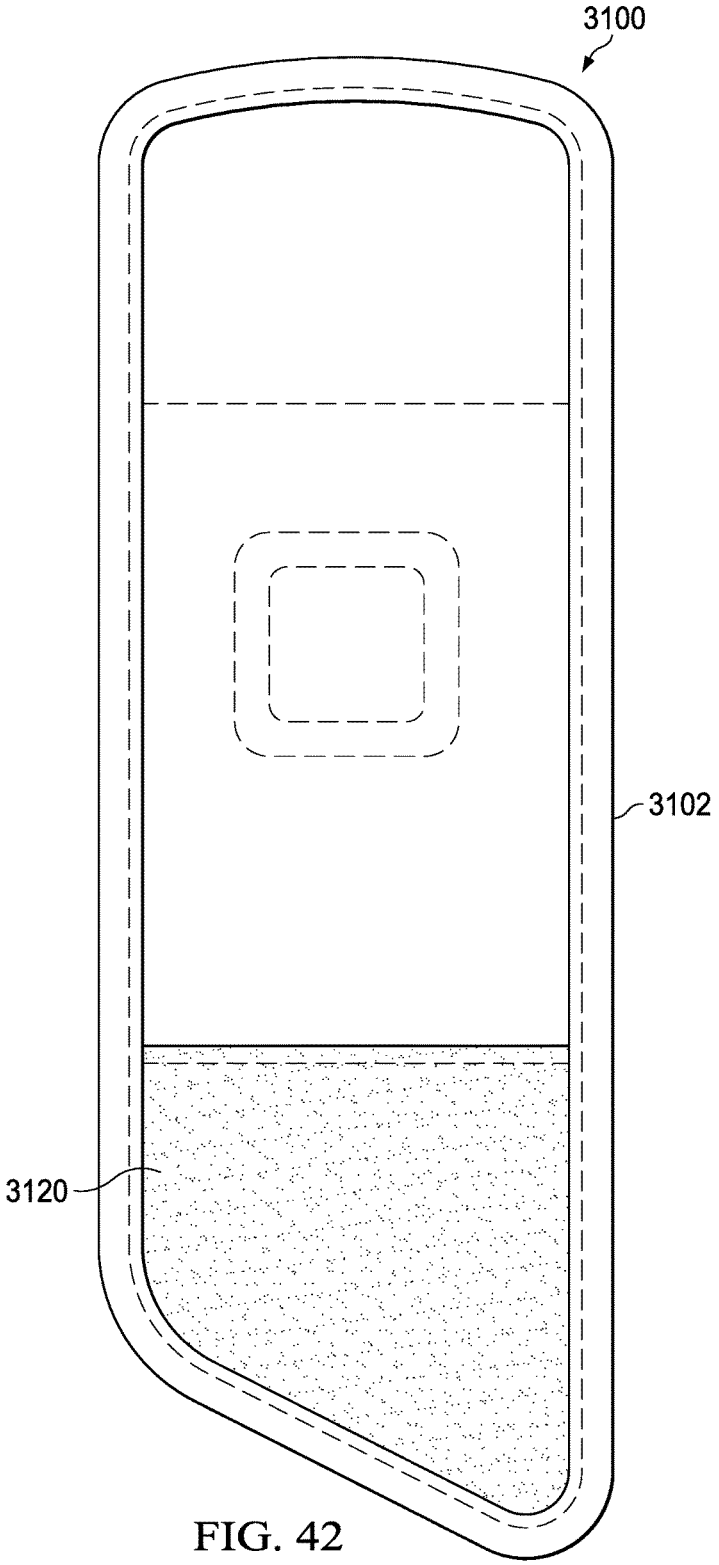
FIG. 42 is another orthogonal view of the stock unit of FIG. 41.
Figure 43:
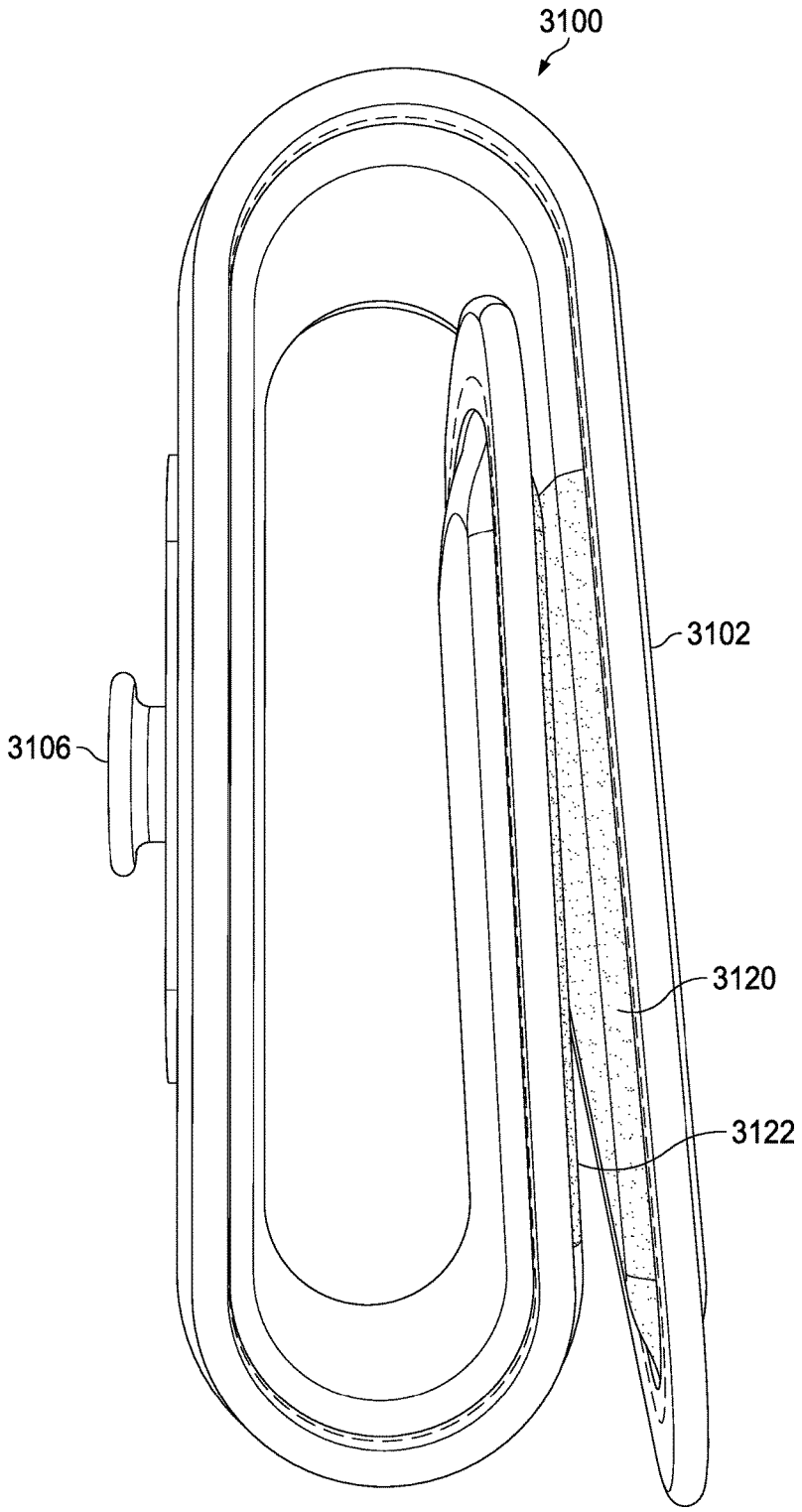
FIG. 43 is another orthogonal view of the stock unit of FIG. 41 with the stock unit in an overlap loop configuration.

The belt unit 2002 comprises substantially similar properties as the belt unit 104, but the user will now move the belt unit 2002 is located on the front of the user just off the normal belt buckle area instead of the side of the user. The reason for the front location is to accommodate carrying a weapon with a Picatinny rail in the front instead of on the side. The knuckle clamp 2004 that attaches to the side rail of the Picatinny rail system can be removed and applied easily by utilizing a thumbscrew 2006 that locks the knuckle clamp 2004 into place on the rail system when tightened and allows the knuckle clamp 2004 to be removed when loosened. The knuckle clamp 2004 comprises a knuckle 2008 integrated into the top plate of the knuckle clamp 2004 itself. The knuckle 2008 can be substantially similarly sized and shaped as the knuckle 106 of system 100. FIG. 28 shows a close up view of a knuckle clamp 2004.

When the belt unit 2002 and knuckle clamp 2004 are in place and the user has the weapon in the front carry position, the system 2000 is ready to be utilized. The user can place the knuckle 2008 into the belt unit 2002, thereby allowing the weight of the weapon to transfer to the belt unit 2002 and ultimately the belt and/or waist of the user. This weight is adjustable as the user can regulate the amount of weight that is delivered into the belt unit 2002 by how much tension is placed on the sling. The looser the sling the more weight is transferred to the belt unit 2002.

FIGS. 29-32 show a system such as system 100 in use with a supported weapon in a variety of positions relative to a user.

Referring now to FIGS. 33-43, a firearm support system (FSS) 3100 is disclosed as comprising a stock unit 3102 and a belt unit 3104. The stock unit 3102 comprises a first complementary component 3106 and the belt unit 3104 comprises a second complementary component 3108 that is configured for selective engagement with the first complementary component 3106. In this embodiment, the first complementary component 3106 comprises a raised button, knuckle, and/or male component generally comprising a rounded head carried by a central shaft. In this embodiment, the second complementary component 3108 comprises a U-shaped receiver channel configured to allow the central shaft to slide into the U-shaped receiver channel while also being configured to at least partially selectively capture the first complementary component 3106.

The stock unit 3102 can be attached to a firearm (rifle, shotgun, long arm weapons, and/or the like). In some cases, the FSS 3100 can be used in conjunction with use of a should strap and/or shoulder carrying sling. The belt unit 3104 may comprise plastic and may be approximately 4" long and 1.5"-2" wide. A curvature 3110 in the belt unit 3104 allows for a comfortable fit with openings 3112 on each end of the belt unit 3104 for the belt to be run through and attached to a user on the hip and/or waist area. The second complementary component 3108 may be attached to the plastic unit and may comprise a long vertical area that allows the male part of first complementary component 3106 to slide into a channel of the second complementary component 3108 and be selectively held in place. In this embodiment, the belt unit 3104 comprises a locking mechanism 3114 to keep the joinder between the first complementary component 3106 and the second complementary component 3108. The locking mechanism 3114 comprise a deflectable biased integral ramp 3116 that carries a catch 3118 that allows selective keeping of the joinder between the first complementary component 3106 and the second complementary component 3108. The belt unit 3104 can be formed via a plastic injection mold. With sufficient introduction of the knuckle portion of the first complementary component 3106 into the channel of the second complementary component 3108, the stock unit 3102 can be automatically captured by the belt unit 3104. The stock unit 3102 and the belt unit 3104 safely can then be separated by simply pressing and deflecting the integral ramp 3116 toward the curvature 3110 until the catch 3118 no longer obstructs removal of the first complementary component 3106. With the integral ramp 3116 sufficiently deflected toward the curvature 3110, the first complementary component 3106 can be removed from the second complementary component 3108.

In some embodiments, when a weapon is attached by a shoulder strap and a FSS 3100, the weapon is securely connected in two areas providing additional safety, security, and/or comfort. The FSS 3100 can allow the user to transfer the weight of the weapon from the shoulder strap area to the hip area where the belt unit 3104 and stock unit 3102 join. When the weapon is unstrapped from the shoulder the weapon will still be attached to the belt unit 3104 and the barrel of the gun will rotate in a safer position pointing towards the ground, allowing user's hands to be free. The amount of weight transferred to the belt unit 3104 may be determined by the amount of tension that is applied to the weapon sling. The looser the sling, the more weight may be transferred to the belt unit 3104.

In some embodiments, the stock unit may be primarily made of neoprene which stretches to make a custom fit on the stock. In some embodiments a hook type material 3120, such as utilized by Velcro, is attached to one end of the stock unit 3102 and the user wraps the stock unit 3102 around the stock and forms an overlapping loop using loop type material 3122, such as utilized by Velcro, and thereby forming a custom tight fit around the stock. The male part (or knuckle) is attached to the neoprene or other material and allows the weapon to be attached to user when the weapon is attached to the belt unit 3104. The ability of the neoprene material, along with the Velcro type materials allow the used to make a tight fit on the stock so that when the weight of the weapon is applied, the stock unit resists bunching up toward the comb or neck of the stock.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A firearm support system, comprising:

a stock unit configured to be carried by a firearm, the stock unit comprising a first complementary component; and a belt unit configured to be carried by a belt, the belt unit comprising a second complementary component configured for selective engagement with the first complementary component;

wherein the second complementary component comprises a channel extending generally in a vertical direction and wherein the first complementary component is configured to selectively move within the channel in the vertical direction;

wherein the belt unit comprises at least two openings extending substantially longitudinally in the vertical direction and configured to receive a belt, at least one of the at least two openings being located leftward relative to the channel when the belt unit is viewed from a front side of the belt unit and at least one of the at least two openings being located rightward relative to the channel when the belt unit is viewed from the front side; and wherein the second complementary component comprises a ramp that extends forward from the rear plate, wherein the at least two openings are formed in the rear plate, and wherein the at least two openings are located rearward relative to the ramp when the belt unit is viewed from above.

2. The firearm support system of claim 1, wherein the stock unit comprises a hook and loop type fastener.

3. The firearm support system of claim 1, wherein the first complementary component comprises a disc shaped head attached to a shaft.

4. The firearm support system of claim 1, wherein the second complementary component comprises a U-shaped channel.

5. The firearm support system of claim 1, wherein the second complementary component comprises a catch carried by the ramp.

6. The firearm support system of claim 1, wherein the second complementary component comprises a catch carried by the ramp and wherein the ramp is configured for selective deflection toward a curvature of the belt unit.

7. The firearm support system of claim 1, wherein the belt unit comprises at least two openings located leftward relative to the channel when the belt unit is viewed from the front.

8. The firearm support system of claim 1, wherein the belt unit comprises at least two openings located rightward relative to the channel when the belt unit is viewed from the front.

9. A firearm support system, comprising:

a stock unit configured to be carried by a firearm, the stock unit comprising a first complementary component; and a belt unit configured to be carried by a belt, the belt unit comprising a second complementary component configured for selective engagement with the first complementary component, the belt unit comprising a substantially rigid curved rear plate;

wherein the second complementary component comprises a channel extending generally in a vertical direction and wherein the first complementary component is configured to selectively move within the channel in the vertical direction; and wherein the belt unit comprises at least four openings extending substantially longitudinally in the vertical direction and configured to receive a belt, at least two of the at least four openings being located leftward relative to the channel when the belt unit is viewed from a front side of the belt unit and at least two of the at least four openings being located rightward relative to the channel when the belt unit is viewed from the front side; and wherein the second complementary component comprises a biased ramp that extends forward from the rear plate, wherein the at least four openings are formed in the rear plate, and wherein the at least four openings are located relatively rearward relative to the ramp when the belt unit is viewed from above.

10. A firearm support system, comprising:

a stock unit configured to be carried by a firearm, the stock unit comprising a first complementary component; and a belt unit configured to be carried by a belt, the belt unit comprising a second complementary component configured for selective engagement with the first complementary component;

wherein the second complementary component comprises a channel extending generally in a vertical direction and wherein the first complementary component is configured to selectively move within the channel in the vertical direction; and wherein the second complementary component comprises a catch carried by a biased ramp and wherein the ramp is biased toward a front of the belt unit;

wherein the biased ramp extends forward from the rear plate, wherein at least two openings are formed in the rear plate, and wherein the at least two openings are located rearward relative to the biased ramp when the belt unit is viewed from above.

* * * * *